US007730959B2

(12) United States Patent
Fischer

(10) Patent No.: US 7,730,959 B2
(45) **Date of Patent: *Jun. 8, 2010**

(54) EARLY SUPPRESSION FAST RESPONSE FIRE PROTECTION SPRINKLER

(75) Inventor: Michael A. Fischer, West Kingston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/624,936

(22) Filed: Jan. 19, 2007

(65) Prior Publication Data

US 2007/0114047 A1 May 24, 2007

Related U.S. Application Data

(63) Continuation of application No. 09/292,152, filed on Apr. 15, 1999, now Pat. No. 7,165,624, and a continuation-in-part of application No. 09/134,493, filed on Aug. 14, 1998, now Pat. No. 6,059,044, and a continuation-in-part of application No. 09/079,789, filed on May 15, 1998, now abandoned.

(51) Int. Cl.
*A62C 37/08* (2006.01)

(52) U.S. Cl. ..... 169/37; 169/16; 169/39; 169/46; 239/518; 239/498

(58) Field of Classification Search ..... 169/37, 169/38, 39, 40, 41, 46, 16; 239/208, 209, 239/504, 524, 525, 501, 506
See application file for complete search history.

(56) References Cited

U.S. PATENT DOCUMENTS 316,581 A 4/1885 Stratton (Continued)

FOREIGN PATENT DOCUMENTS

JP 04-329969 11/1992

(Continued)

OTHER PUBLICATIONS

Plaintiff Tyco—Complaint in *Tyco Fire Prods. LP* (Plaintiff Tyco) v. *The Viking Corp.* (6 pages) (Defendant Viking) (Apr. 26, 2007).

(Continued)

*Primary Examiner*—Dinh Q Nguyen
(74) *Attorney, Agent, or Firm*—Perkins Coie LLP

(57) ABSTRACT

An early suppression fast response pendent-type fire protection sprinkler is suitable for use in accordance with one or more of NFPA 13, NFPA 231 and NFPA 231C to protect single row rack storage, double row rack storage and multiple row rack storage, the sprinkler having a K-factor of about 25 and flowing pressure of about 15 pounds per square inch. Preferably, the sprinkler has a body defining an orifice and an outlet for delivering a flow of fluid from a source, and a deflector mounted with a first surface opposed to flow of fluid from the outlet. The deflector defines at least one pair of generally opposed reentrant slots extending from the first surface through the deflector, the reentrant slots extending from slot openings at an outer peripheral edge of the deflector inwardly from the peripheral edge toward a deflector axis.

83 Claims, 9 Drawing Sheets

U.S. PATENT DOCUMENTS

| | | | | | |
|---|---|---|---|---|---|
| 546,087 | A | | 9/1895 | Carpenter | |
| 720,013 | A | | 2/1903 | Esty | |
| 824,128 | A | | 6/1906 | Martin | |
| 1,165,313 | A | | 12/1915 | Bower | |
| 1,285,133 | A | | 11/1918 | Gross | |
| 2,135,138 | A | * | 11/1938 | Kendall | 239/498 |
| 2,357,227 | A | | 8/1944 | Rowley | |
| 2,591,872 | A | | 4/1952 | Rider | |
| 2,862,565 | A | | 12/1958 | Dukes | |
| 3,195,647 | A | | 7/1965 | Campbell et al. | |
| 3,525,402 | A | | 8/1970 | Hattori | |
| 3,561,537 | A | | 2/1971 | Dix | |
| 3,653,444 | A | | 4/1972 | Livingston | |
| 3,682,251 | A | | 8/1972 | Livingston | |
| 3,716,103 | A | | 2/1973 | Tanaka et al. | |
| 3,722,596 | A | | 3/1973 | Livingston | |
| 3,743,022 | A | | 7/1973 | Livingston | |
| 3,768,736 | A | | 10/1973 | Cox | |
| 3,783,947 | A | | 1/1974 | Dix et al. | |
| 3,812,915 | A | | 5/1974 | Livingston | |
| 3,834,463 | A | | 9/1974 | Allard et al. | |
| 3,888,313 | A | | 6/1975 | Freeman | |
| 3,904,126 | A | | 9/1975 | Allard | |
| 4,091,873 | A | | 5/1978 | Werner | |
| 4,099,675 | A | | 7/1978 | Wohler et al. | |
| 4,136,740 | A | | 1/1979 | Groos et al. | |
| 4,279,309 | A | | 7/1981 | Fischer et al. | |
| 4,296,815 | A | | 10/1981 | Mears | |
| 4,296,816 | A | | 10/1981 | Fischer | |
| 4,405,018 | A | | 9/1983 | Fischer | |
| 4,580,729 | A | | 4/1986 | Pounder | |
| 4,657,085 | A | | 4/1987 | Jacobsen | |
| 4,800,961 | A | | 1/1989 | Klein | |
| 4,901,799 | A | | 2/1990 | Pepi et al. | |
| 4,930,578 | A | | 6/1990 | Barnett et al. | |
| 5,036,923 | A | | 8/1991 | Shea | |
| 5,094,298 | A | | 3/1992 | Polan | |
| 5,152,344 | A | | 10/1992 | Fischer et al. | |
| 5,366,022 | A | | 11/1994 | Meyer et al. | |
| 5,579,846 | A | | 12/1996 | Meyer et al. | |
| 5,584,344 | A | | 12/1996 | Meyer et al. | |
| 5,609,211 | A | | 3/1997 | Meyer et al. | |
| 5,628,367 | A | | 5/1997 | Truax et al. | |
| 5,664,630 | A | | 9/1997 | Meyer et al. | |
| 5,687,914 | A | | 11/1997 | Bosio et al. | |
| 5,829,532 | A | | 11/1998 | Meyer et al. | |
| 5,839,667 | A | | 11/1998 | Fischer | |
| 5,862,994 | A | | 1/1999 | Pounder et al. | |
| 5,865,256 | A | | 2/1999 | Pounder | |
| 5,890,657 | A | | 4/1999 | Ponte | |
| 5,915,479 | A | * | 6/1999 | Ponte | 169/46 |
| 6,059,044 | A | | 5/2000 | Fischer | |
| 6,450,265 | B1 | | 9/2002 | Ponte | |
| 6,502,643 | B1 | | 1/2003 | Meyer et al. | |
| 6,868,917 | B2 | | 3/2005 | Meyer | |
| 6,976,543 | B1 | * | 12/2005 | Fischer | 169/37 |
| 7,165,624 | B1 | * | 1/2007 | Fischer | 169/37 |

FOREIGN PATENT DOCUMENTS

| | | |
|---|---|---|
| WO | WO 98/18525 | 5/1998 |

OTHER PUBLICATIONS

Defendant Viking—Answer to Complaint, Affirmative Defenses, Counterclaims and Jury Demand (13 pages) (May 16, 2007).

Plaintiff Tyco—Motion to Strike Affirmative Defenses and Memorandum of Law in Support of Motion to Strike; Reply to Counterclaim of Defendant (14 pages) (Jun. 4, 2007).

Plaintiff Tyco—Motion for Preliminary Injunction; Memorandum of Law in Support; Proposed Order; Declaration of J. Golinveaux (46 pages) (Jun. 13, 2007).

Plaintiff Tyco—Declaration of D. Pounder in Support of Motion for Preliminary Injunction (37 pages) (Jun. 14, 2007).

Defendant Viking—Motion For Leave to Amend Answer to Complaint, Counterclaims and Jury Demand; Memorandum in Support of Motion; Exhibits A-C (42 pages) (Jun. 21, 2007).

Defendant Viking—Response in Opposition to Plaintiff's Motion to Strike Affirmative Defenses; Proposed Order; Index of Exhibits; Exhibits A-E (95 pages) (Jun. 21, 2007).

Defendant Viking—Response in Opposition to Plaint. Motion for Preliminary Injunction; Proposed Order; Index of Exhibits; Exhibits A-D; Exhibits F-S (217 pgs) (Jul. 16, 2007).

Defendant Viking—Declaration of T. Deegan in Support of Opposition to Pl. Motion for Preliminary Injunction, Appendices A1, B1, C1; Exhibits 1-27 (372 pages) (Jul. 17, 2007).

Defendant Viking—Declaration of S. Franson in Support of Opposition to Pl. Motion for Prelim Injunction (7 pages) (Jul. 17, 2007).

Defendant Viking—First Amended Answer to Complaint, Affirmative Defenses, Counterclaims and Jury Demand (14 pages) (Jul. 19, 2007).

Plaintiff Tyco—First Amended Complaint (6 pages) (Jul. 30, 2007).

Stipulation of Voluntary Dismissal of Action (2 pages) (Jan. 8, 2008).

Pacer—Civil Docket for *Tyco Fire Products LP* v. *The Viking Corporation* Case No. 2:07-cv-01683-WY (E.D. Pa) (Aug. 29, 2008).

Central Sprinkler Company data sheets for "Ultra K25 ESFR Low Pressure Early Suppression Fast Response" (4 pages) (1998).

Excerpt from "UL 199, Standard for Automatic Sprinklers for Fire-Protection Service," (Apr. 8, 1997), describing so-called 10 Pan Distribution Test, pp. 31-32.

Underwriters Laboratories Inc., UL 1767, "Standard for Safety, Early-Suppression Fast-Response Sprinklers," First Edition, Feb. 1990.

Factory Mutual Engineering Corp., "Loss Prevention Data 2-2, Early Suppression Fast Responses Sprinklers," Apr. 1987.

Factory Mutual Research, "Approval Standard, Early Suppression Fast Responses Automatic Sprinklers," Jun. 1986.

"Automatic" Sprinkler Corporation of America product sheets entitled Automatic ESFR Glass Bulb Sprinkler, Feb. 1988, pp. J 5.3, J 5.4.

ASCOA First Systems data sheets entitled "Automatic ESFR Glass Bulb Sprinkler," Mar. 1992, pp. 1.1, 1.2.

Grinnell Corporation data sheets entitled "Early Suppression Fast Response Sprinklers/Model ESFR-1 Pendent, 14.3 K-Factor," Apr. 1988.

Reliable Automatic Sprinkler product announcement, "ESFR Model H Early Suppression Fast Response Sprinklers," Oct. 1992, 3 pp. total.

Central Sprinkler Company catalog sheets entitled Central ESFR-1 3-93/ESFR Early Suppression Fast Response, Mar. 1993, 4 pps.

Drawing entitled, "International Jumbo Sprinkler Head-Deflector," DWG No. 1-117, Automatic Sprinkler Co. of America, Mar. 1926, 1 pg.

Sheet entitled, "Grinnell Jumbo Sprinkler Issue A," Grinnell Corp., Feb. 1969, 1 pg.

Drawing entitled "Solder-Type-Issue A 1/14," Grinnell Sprinkler Yoke, Body, Strut, Diaphragm and Disc, General Fire Extinguisher Company, Apr. 1917, 1 pg.

Drawing entitled "1 Grinnell Jumbo Sprinkler Detail Solder Type Issue A," General Fire Extinguisher Co., Apr. 1917, 1 pg.

NJ Thompson, Fire Behavior and Sprinklers, Chapter 6, "Automatic Sprinkler Protection," National Fire Protection Association, 1964, Forward, Table of Contents, pp. 72-91.

Newsletter for Fire Protection Engineers and Industry, No. 11, Jul. 1968, Orinda, California, 8 pp.

D.G. Goodfellow et al., Technical Report entitled "Optimization of Sprinkler Protection for United States Postal Service III. Protection of Plastic Letter Trays," Factory Mutual Research Corp., Oct. 1971, 39 pp.

D.G. Goodfellow et al., Technical Report entitled "Optimization of Sprinkler Protection for United States Facilities/IV Protection of Plastic Letter Trays with 0.64-in. Retrofit Sprinklers," Factory Mutual Research Corporation, Jul. 1974, 30 pp. with cover and introductory pages.

E.W.J. Troup, Technical Report entitled "New Developments in Ceiling-Level Protection for the High-Challenge Fire," Factory Mutual Research Corporation, Jan. 1974.

P.J. Chicarello et al., Technical Report entitled "Large-Scale Fire Test Evaluation of Early Suppression Fast Response (ESFR) Automatic Sprinklers," Factory Mutual Research Corp. May 1986, cover-p. 18, pp. 122-128.

C. Yao, "The Development of the ESFR Sprinkler System," First Safety Journal, Elsevier Scientific Ltd., Kidlington, Oxford, 1988, vol. 14, No. 11, pp. 65-73.

C. Yao, "Overview of FMRC's Sprinkler Technology Research," Factory Mutual Research Corporation, May 1992.

Approved Product News, Factory Mutual Engineering Corp., vol. 4, No. 2, Dec. 1998, pp. 1-5, 8-12, 16.

Fire Protection Handbook, 17$^{th}$ Edition, National Fire Protection Association, 1991, Title page, inner page, Table of Contents, p. IX and pp. 5-127 through 5-163 and 5-174 through 5-197.

K. Bell, "Presentation to American Fire Sprinkler Association-Large K-Factor Sprinklers," Nov. 1992, 59 pp. total; 19 pp. text and 40 pp. slide photocopies.

Six photographs of sprinkler case with "I.S. Co." on deflector and PAT.03 on the body and 1903 stamped on the release link, labeled Jun. 1995, 2 pp.

Six photographs of sprinkler case with "Globe" and 280 on body, G A S Co. on deflector and stamped 1926 on release ink, labeled Jun. 1995, 2 pp.

Five photographs of Grinnell Corporation "Jumbo A Automatic Sprinkler-1¼" Orifice, labeled Jun. 1995, 2 pp.

Five photographs of Grinnell Corporation, "Jumbo A automatic sprinkler—1" orifice, labeled Jun. 1995, 2 pp.

Search Report under Section 17, issued by GB Patent Office for corresponding GB Patent Application No. 9911294.8, dated Aug. 24, 1999.

National Fire Protection Associate, NFPA 13—Standard for the Initiation of Sprinkler System, 1996 edition, pp. 13-1 through 13-148.

National Fire Protection Associate, NFPA 231—Standard for General Storage, 1998 edition, pp. 231-1 through 231-31.

National Fire Protection Associate, NFPA 231C—Standard for Rack Storage of Materials, 1998 edition, pp. 231C-1 through 231C-75.

Parent Application, File History of U.S. Appl. No. 09/292,152, filed Apr. 15, 1999, now U.S. Patent No. 7,165,624, Michael Fischer.

Parent Application, File History of U.S. Appl. No. 09/134,493, filed Aug. 14, 1998, now U.S. Patent No. 6,059,044, Michael Fischer.

Parent Application, File History of U.S. Appl. No. 09/079,789, filed May, 15, 1998, now Abandoned, Michael Fischer.

"Discussion Materials from the Examiner Interview of Feb. 22, 2010", 313 pages.

* cited by examiner

EARLY SUPPRESSION FAST RESPONSE FIRE PROTECTION SPRINKLER

CROSS REFERENCE TO RELATED APPLICATIONS

This application is a continuation of U.S. application Ser. No. 09/292,152, filed Apr. 15, 1999, which is now issued as U.S. Pat. No. 7,165,624, and a continuation-in-part of U.S. application Ser. No. 09/134,493, filed Aug. 14, 1998, which is now issued as U.S. Pat. No. 6,059,044, issued May 9, 2000, and a continuation-in-part of U.S. application Ser. No. 09/079,789, filed May 15, 1998, which is now abandoned.

BACKGROUND OF THE INVENTION

Fire protection sprinklers may be operated individually, e.g. by a self-contained thermally sensitive element, or as part of a deluge system in which fire retardant fluid flows through a number of open sprinklers, essentially simultaneously. Fire retardant fluids may include natural water or appropriate mixtures of natural water and one or more additives to enhance fire fighting properties of a fire protection system.

Fire protection sprinklers generally include a body with an outlet, an inlet connectable to a source of fire retardant fluid under pressure, and a deflector supported by the body in a position opposing the outlet for distribution of the fire retardant fluid over a predetermined area to be protected from fire Individual fire protection sprinklers may be automatically or non-automatically operating. In the case of automatically operating fire protection sprinklers, the outlet is typically secured in the normally closed or sealed position by a cap. The cap is held in place by a thermally-sensitive element which is released when its temperature is elevated to within a prescribed range, e.g. by the heat from a fire. The outlets of non-automatic sprinklers are maintained normally open, and such sprinklers are operated in an array, as part of a deluge system, from which fire retardant fluid flows when an automatic fluid control valve is activated by a separate fire, e.g. heat, detection system.

Installation or mounting position is another parameter which distinguishes different types of fire protection sprinklers. For example: Pounder U.S. Pat. No. 4,580,729 illustrates a pendent mounting (i.e., pendent-type) sprinkler arranged so that the fluid stream discharged from the outlet is directed initially downwards against the deflector; Dukes U.S. Pat. No. 2,862,565 illustrates an upright mounting (i.e., upright-type) sprinkler arranged so that the fluid stream discharged from the outlet is directed initially upwards against the deflector; and Mears U.S. Pat. No. 4,296,815 and Fischer U.S. Pat. No. 4,296,816 illustrate a horizontal mounting (i.e., horizontal-type) sprinkler arranged so that the fluid stream discharged from the outlet is directed initially horizontally against the deflector. In each case, the purpose of the deflector is to break up the fluid stream into a pattern of spray that can suitably cover the area to be protected by the sprinkler from fire.

ESFR (Early Suppression Fast Response) fire protection sprinkler applications have typically required the use of pendent sprinklers. Upright and horizontal sprinklers have generally been found less suitable for ESFR applications, particularly at commodity storage heights of greater than 30 feet. This is because upright sprinklers inherently have reduced downward spray directly beneath the sprinklers and, therefore, underneath the fire protection fluid supply piping from which they are fed. Horizontal type sprinklers, on the other hand, are generally designed with a spray pattern that projects horizontally to protect more remote reaches of the intended coverage area and, as such, do not provide the downward thrust of fluid spray necessary for ESFR sprinkler applications, over the entire area to be protected from fire by the sprinkler.

The concept underlying ESFR sprinkler technology is that of delivering onto a fire at an early stage a quantity of water sufficient to suppress the fire before a severe challenge can develop. ESFR sprinklers are particularly useful in commercial settings where the clearance between the sprinklers and the source of the fire could be large. For example, in a warehouse having high ceilings, the distance between pendent sprinklers and the upper surfaces of combustible commodities in the storage racks can be relatively large. In such settings, the size of a fire can grow significantly before a first sprinkler is activated by heat from the fire. Thus, it was recognized that to suppress a fire in such a setting, a greater quantity of water should be delivered quickly so that the fire will be kept less intense, and the corresponding convective heat release rate will be kept lower In turn, with a lower heat release rate, the upward plume velocity of the fire will also be relatively lower Fire protection specialists often characterize this concept by saying that the Actual Delivered Density (ADD) of the first operating sprinkler(s) should exceed the Required Delivered Density (RDD). RDD is defined as the actual density of fire retardant fluid required to suppress a fire in a particular combustible commodity in units of $gpm/ft^2$. ADD is generally defined as the density at which water is actually deposited from operating sprinklers onto the top horizontal surface of a burning combustible array, in units of $gpm/ft^2$.

The relationships between sprinkler spray patterns, fire plume velocity, and amount of combustible commodity are important factors which need to be taken into account in the design of ESFR sprinklers. As the ceiling-to-floor distance increases and the amount of combustible commodity increases, the fire plume velocity and upward thrust increase to such vigorous levels that standardized tests now require actual opposing thrust specifications in the central area of the spray pattern for certification of an automatic fire protection sprinkler for service in the ESFR sprinkler category (Ref. Underwriters Laboratories (UL) and Factory Mutual (FM) ESFR Sprinkler Standards). Previous approaches for addressing higher elevation, higher challenge fire protection applications with ESFR pendent sprinklers have included using deflectors with straight slots or slots that taper to become slightly wider in the radially outward direction, in combination with increasing fluid water pressure to compensate for increased elevations, since the thrust of the spray pattern is a combination of both velocity and mass of the fire retardant fluid droplets.

ESFR pendent sprinklers often provide a sprinkler spray pattern having a central downward thrusting core formation. Providing a central core of high thrust droplets is particularly important in higher elevation, higher challenge fire protection applications where the updraft of a quickly developing fire located under a sprinkler head could fully displace the spray pattern of the sprinkler head if the downward thrust was insufficient to effectively oppose the updraft. One approach for providing more water coaxial with the centerline of the sprinkler spray pattern is described in Mears U.S. Pat. No. 4,296,815, the entire disclosure of which is incorporated herein by reference. Mears '815 describes a horizontal sidewall sprinkler with a discharge which increases the amount of fire protection fluid in the region coaxial with the sprinkler discharge axis by use of a deflector with radially extending tines spaced by reentrant slots. A reentrant slot is defined as a cutout extending through a deflector and generally radially inwardly from an opening at the deflector periphery, the slot having a transverse width which is larger at a more radially inward portion of the deflector than the transverse width nearer the peripheral region of the deflector.

SUMMARY OF THE INVENTION

The invention relates to pendent-type fire protection sprinklers of the type including a sprinkler body defining an orifice and an outlet for delivering a flow of fluid from a source, and at least one arm extending from the sprinkler body. The orifice defines an orifice axis, and the outlet is disposed generally coaxial with the orifice axis. The sprinkler also includes an apex element supported by the arm, with an apex axis generally coaxial with the orifice axis, and a deflector mounted to the apex element at a distance further from the outlet than the apex element.

In a general aspect of the invention, the deflector includes a deflector body defining a first, inside surface opposed to the flow of fluid, an opposite, second surface, and a deflector axis generally coaxial with the orifice axis. The deflector body defines two or more generally opposing reentrant slots extending through the deflector body, from the first, inside surface to the second, outside surface, with the slot openings at an outer peripheral edge of the deflector body. The reentrant slots extend inwardly from the peripheral edge, each along a reentrant slot centerline or axis, generally toward the deflector axis. Each reentrant slot also has a first width measured transverse to the slot centerline in a region of the peripheral edge and a second width measured transverse to the slot centerline at a regions spaced inwardly, toward the deflector axis, relative to the region of the peripheral edge, the second width being greater than the first width. The innermost portion of each reentrant slot extends inwardly toward the deflector axis so as to be no further outward from the deflector axis than the outermost surface of the apex element.

The portion of the deflector between the slots extending inward from the periphery of the deflector and the larger width opening at the radially more inward portion of the deflector provides a web-like component spray pattern extending outward from the central core formation.

Pendent-type fire protection sprinklers of the invention are fixed deflector, impingement-type fire protection sprinklers in which the body defines an inlet for connection to a source of fluid under pressure, an outlet, and an orifice normally located just upstream of the outlet. The outlet may be normally closed by a plug held in place by a thermally responsive element configured to automatically release the plug when the temperature of the thermally responsive element is elevated to within a prescribed range Upon operation (i.e., release of the plug), whether the fire protection sprinkler is individually operated or used open as part of a local application or total flooding system, a vertically directed, relatively coherent, single stream of water (downward for pendent-type sprinklers) rushes through the outlet, from the orifice, towards the deflector. As it impacts (i e, impinges) upon the deflector, the water is diverted generally radially downward and outward, breaking up into a spray pattern, the configuration of which, in large part, is a function of the deflector design, and it is projected over the intended area of coverage, i.e., the protected area.

The flow rate "Q" from a sprinkler in which a single stream of water is discharged from the outlet orifice, expressed in U.S. gallons per minute (gpm), is determined by the formula:

$$Q=K(p)^{1/2}$$

where:

"K" represents the nominal nozzle discharge coefficient (normally referred to as K-factor), and "p" represents the residual (flowing) pressure at the inlet to the nozzle in pounds per square inch (psi)

Fire protection sprinklers of the invention operate by impacting a relatively coherent, single fluid jet against the deflector described above. The sprinkler has a K-factor preferably in a range of from about 8.0 to 50.0, more preferably in the range of about 14.0 to about 30.0, and most preferably about 25.0, the range from about 14.0 to 30.0 being found more preferable from the standpoint of minimizing fire protection system installation costs and operating power requirements Larger K-factors have been determined to be capable of delivering quantities of fire retardant fluid sufficient for an ESFR sprinkler application. As the elevation of the particular hazard increases (i.e., taller warehousing), the pressure required to deliver quantities of fluid sufficient to produce the downward thrust necessary to oppose well developed fire updrafts from such elevations becomes so high as to be impractical when K-factors are less than about 8.0. However, for K-factors of about 140 or greater, and at the required delivered rate of fire retardant fluids, a sprinkler pressure sufficient to produce the required downward thrust by traditional deflector means is practical to achieve, but may not be as economical as desired.

In preferred embodiments, the deflector compensates for the lower droplet velocities at the lower inlet pressures desirable for the larger K-factor sprinklers by diverting an optimized portion of the spray selectively directed within the spray pattern. The deflector is provided with at least one set of reentrant slots positioned so that their most radially inward portion is no further outward from the deflector axis than the outermost surface of the apex element of the sprinkler frame. With this arrangement, there is diverted a quantity of fire retardant fluid sufficient to produce the required amount of thrust in the inner, downwardly-directed portion of the spray pattern at pressures lower than those produced by either straight slots or slots that taper to become slightly wider in the radially outward direction.

According to the invention, an early suppression fast response pendent-type fire protection sprinkler suitable for use in accordance with one or more of NFPA 13, NFPA 231 and NFPA 231C to protect single row rack storage, double row rack storage and multiple row rack storage has a K-factor of about 25 and a flowing pressure of about 15 pounds per square inch.

Preferred embodiments of the invention may have one or more of the following additional features. The sprinkler further comprises a sprinkler body defining an orifice and an outlet for delivering a flow of fluid from a source, and a deflector mounted with a first surface opposed to flow of fluid from the outlet, the deflector defining at least two reentrant slots disposed in opposition about a deflector axis, the reentrant slots extending from the first surface through the deflector, and the reentrant slots extending from slot openings at an outer peripheral edge of the deflector inwardly from the peripheral edge toward the deflector axis. Preferably, the reentrant slots extend inwardly along reentrant slot centerlines, and each of the reentrant slots has a first width transverse to its reentrant slot centerline in a region of the peripheral edge and a second slot width transverse to its reentrant slot centerline in a region spaced inwardly, toward the deflector axis, relative to the region of the peripheral edge, the second width being greater than the first width. More preferably, the sprinkler further comprises an apex element, the deflector is mounted to the apex element, and an innermost portion of each of the reentrant slots extends inwardly toward the deflector axis to be no further outward from the deflector axis than an outermost surface of the apex element, and, preferably, the innermost portions of the reentrant slots extend inwardly toward the deflector axis to underlie the apex element, relative to fluid flow direction from the outlet. The reentrant slot centerlines extend radially outward from the deflector axis. The sprinkler is suited for installation up to 18 inches below a ceiling. The deflector has a thickness measured from the first surface in the direction of fluid flow equal to or greater than about 0.06 inch. The reentrant slots comprise a plurality of reentrant slots comprising at least a first type of reentrant slot and a second type of reentrant slot, reentrant slots of the first type extending from the first surface through the deflector with the slot openings at an outer peripheral edge of the deflector body, each of the reentrant slots of the first type extending inwardly from the peripheral edge, along the reentrant slot centerlines, generally toward the deflector axis, to a first type length, reentrant slots of the second type extending through the deflector from the first surface, with the slot openings at the peripheral edge of the deflector body, each of the reentrant slots of the second type extending inwardly from the peripheral edge, along the reentrant slot centerlines, generally toward the deflector axis, to a second type length, and the innermost portions of the reentrant slots of the first type extending inwardly toward the deflector axis to be no further outward from the deflector axis than the outermost surface of the apex element. Preferably, each of the reentrant slots of the first type has a first width transverse to its slot centerline in a region of the peripheral edge and a second width transverse to its slot centerline in a region spaced inwardly, toward the deflector axis, relative to the region of the peripheral edge, the second width of the first type slots being greater than the first width of the first type slots, and each of the reentrant slots of the second type has a first width transverse to the slot centerline in a region of the peripheral edge and a second width transverse to the slot centerline in a region spaced inwardly, toward the deflector axis, relative to the region of the peripheral edge, the second width of the second type slots being greater than the first width of the second type slots. The first type length is equal to or greater than the second type length. The reentrant slot centerlines of the reentrant slots of the first type extend substantially radially outward from the deflector axis. The reentrant slot centerlines of the reentrant slots of the second type extend substantially radially outward from the deflector axis. The reentrant slots of the first type comprise at least two pairs of generally opposing reentrant slots The reentrant slots of the second type comprise at least two pairs of generally opposing reentrant slots. The first type length of the reentrant slots of the first type is substantially the same. The second type length of the reentrant slots of the second type is substantially the same. The reentrant slots of the first type define reentrant portions having an elongated shape. The reentrant slots of the second type define reentrant portions having a pear-shape. A reentrant slot of the second type is located between reentrant slots of the first type.

In another aspect of the invention, the deflector body defines reentrant slots including first and second types of reentrant slots, with each type including two or more reentrant slots. At least two, generally opposing reentrant slots of the first type of reentrant slots extend through the deflector body, from the first, inside surface to the second, outside surface, each with the slot opening at an outer peripheral edge of the deflector body and extending inwardly from the peripheral edge, along its reentrant slot centerline, generally toward the deflector axis, to a first type slot length. The reentrant slots of the first type have a first width measured transverse to the slot centerline in a region of the peripheral edge and a second width measured transverse to the slot centerline in a region spaced inwardly, toward the deflector axis, relative to the region of the peripheral edge, the second width being greater than the first width. At least two generally opposing reentrant slots of the second type of reentrant slots also extend through the deflector body, from the first, inside surface to the second, outside surface, with a slot opening at an outer peripheral edge of the deflector body, and extend inwardly from the peripheral edge, along its reentrant slot centerline, generally toward the deflector axis, to a second type slot length. The reentrant slots of the second type have a first width measured transverse to the slot centerline in a region of the peripheral edge and a second width measured transverse to the slot centerline in a region spaced inwardly, toward the deflector axis, relative to the region of the peripheral edge, the second width being greater than the first width. Each of the reentrant slots of the first type is disposed between reentrant slots of the second type, with the first type slot lengths being different from the second type slot lengths.

With this arrangement, the use of alternating pairs of generally opposing reentrant slots of the second type provides an intermediate componentized spray pattern. The intermediate componentized spray pattern is particularly effective in ESFR sprinkler applications where updrafts in regions between the outer shell regions and regions along the central axis of the sprinkler orifice are created. Such updrafts are often created in higher elevation, higher challenge settings (e.g., warehouses) where the increased elevation allows a fire to grow to a large size before operating a sprinkler head positioned off center from the ignition point of the fire.

These and other features and advantages of the invention will be apparent from the following more detailed description, and from the claims.

DESCRIPTION OF THE PREFERRED EMBODIMENTS

Figure 1:
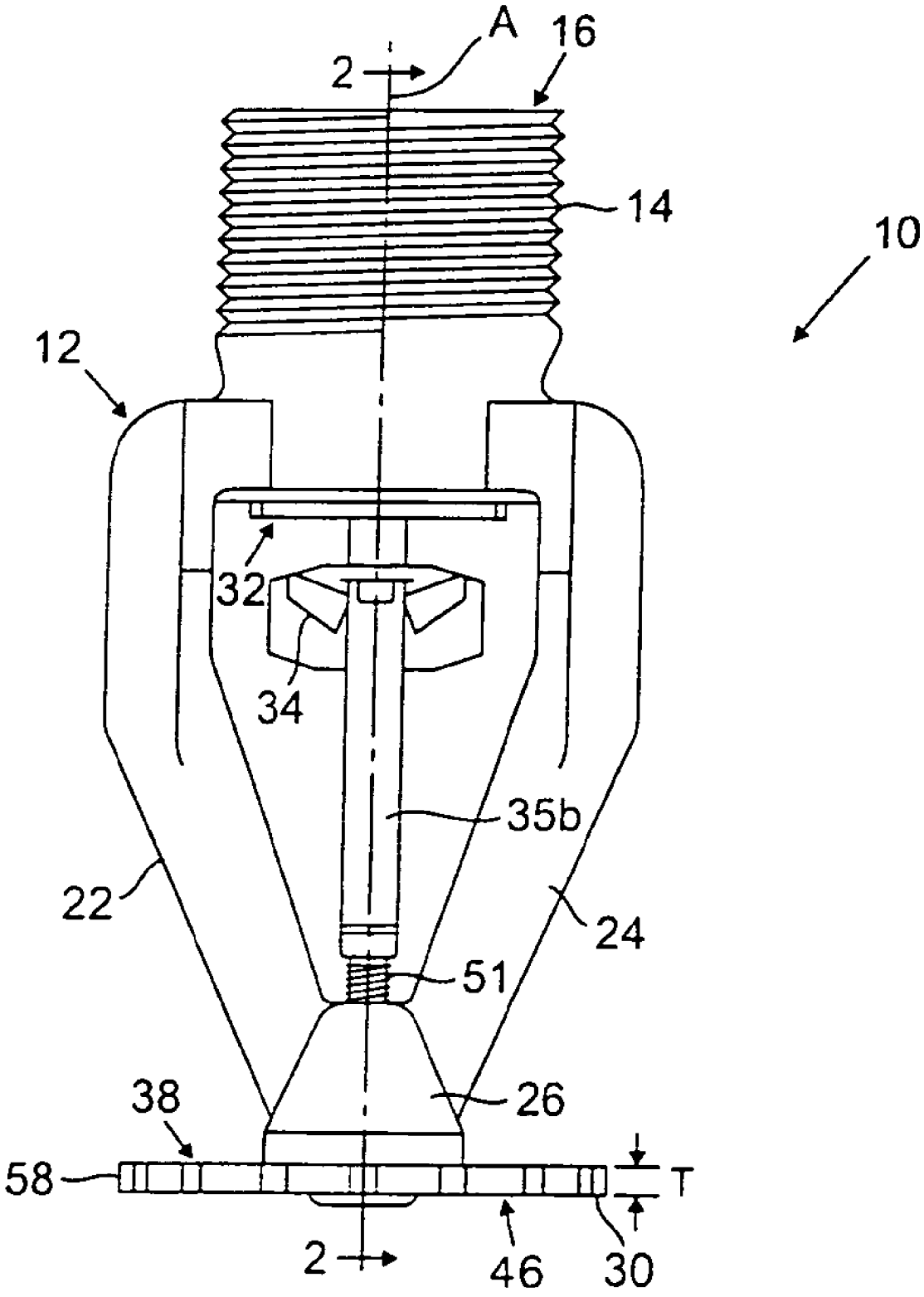
FIG. 1 is a side elevational view of a fire protection sprinkler of the invention.
Figure 2:
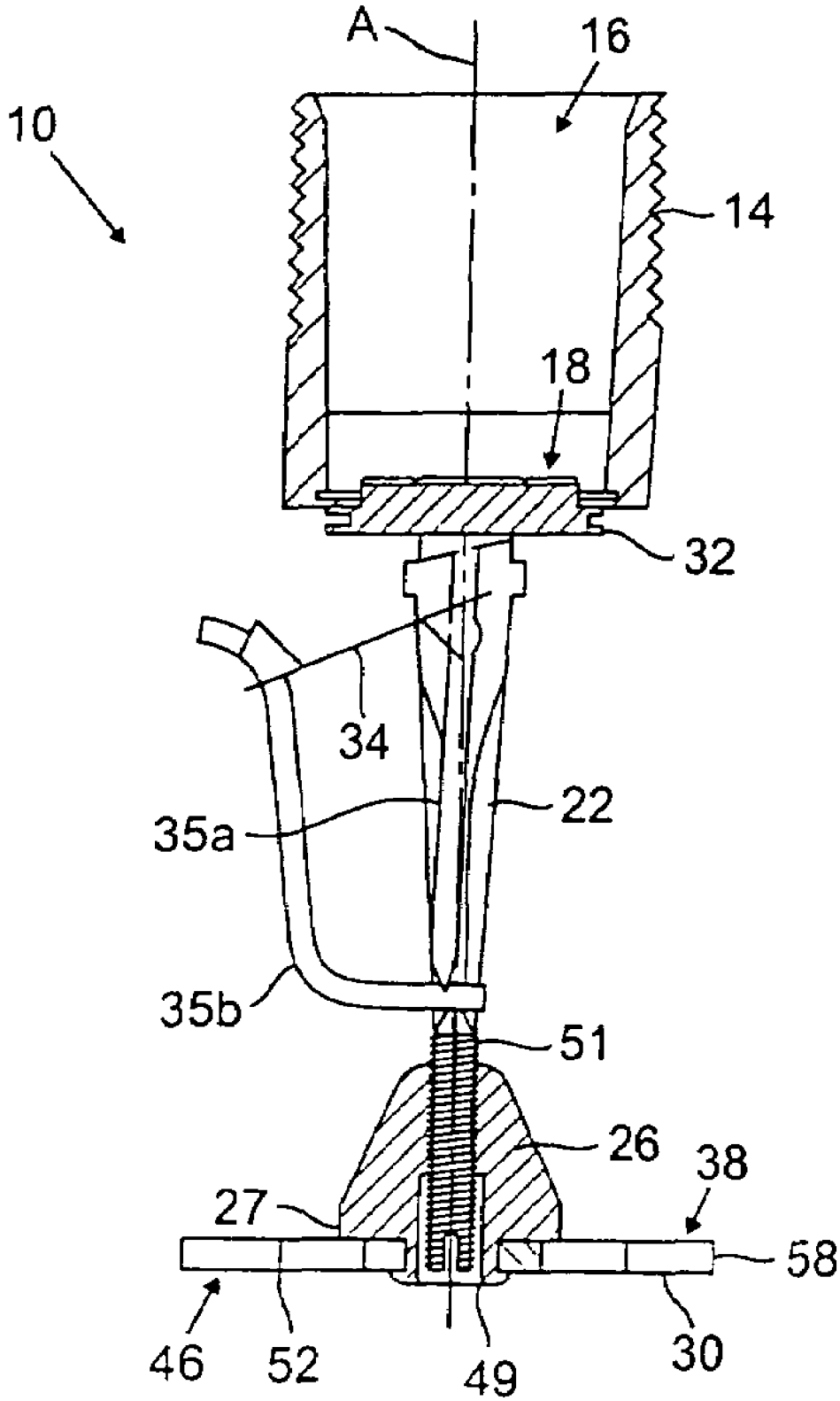
FIG. 2 is a side sectional view of the fire protection sprinkler taken at line 2-2 of FIG. 1.

Referring to FIGS. 1 and 2, a fire protection sprinkler 10 of the deflector impingement pendent-type has a body 12 with a base 14 defining an inlet 16 for connection to a source of fluid under pressure (not shown), and an outlet 18 (FIG. 2) with an axis, A. In certain embodiments, a strainer (not shown) may be located at inlet 16 to prevent debris larger than a preselected combination of dimensions from entering and clogging fluid flow through outlet 18. A pair of U-shaped frame arms 22, 24 extend from opposite sides of the base 14 to join at an apex element 26 at a position downstream of, and generally coaxial with, the outlet 18. Apex element 26 is generally conically-shaped, with the relatively wider diameter end adjacent to a water distribution deflector 30 affixed to, and disposed coaxial with, the apex element 26.

The outlet 18 of the fire protection sprinkler 10 is normally closed by a spring plate assembly 32. The assembly is held in place by a thermally responsive element 34 consisting of two thin sheet metal members secured together by a low temperature fusible solder alloy which separates and automatically releases the spring plate assembly when the thermally responsive element is heated to an elevated temperature within a specified operating temperature range for a pre-selected nominal temperature rating, e.g., 74° C. (165° F.). The retention force applied by the thermally responsive element is transmitted to the spring plate assembly 32 by the load applied through a strut 35*a* via lever 35*b*. In one particular embodiment, the thermally responsive element 34 is available, e g, from Grinnell Corporation, of Exeter, N.H., in temperature ratings of 74° C. (165° F.) and 101° C. (214° F.).

Upon release of spring plate 32, a vertically directed, relatively coherent, single stream of fluid passes through inlet 16, rushing downward from the outlet 18 towards the deflector 30.

Heretofore, it has been known that the parameters establishing spray patterns for a pendent-type sprinkler operating by impacting a single, relatively coherent water jet against a substantially horizontal deflector, include:

form and/or shape of the deflector support structure;

form and/or shape of the deflector;

outside dimensions of the deflector;

shape and arrangement of openings and tines located around the periphery of the deflector; and shape, size, and arrangement of holes located within the central area of the deflector, when such holes are utilized in conjunction with slots and tines located around the periphery of the deflector.

Figure 3:
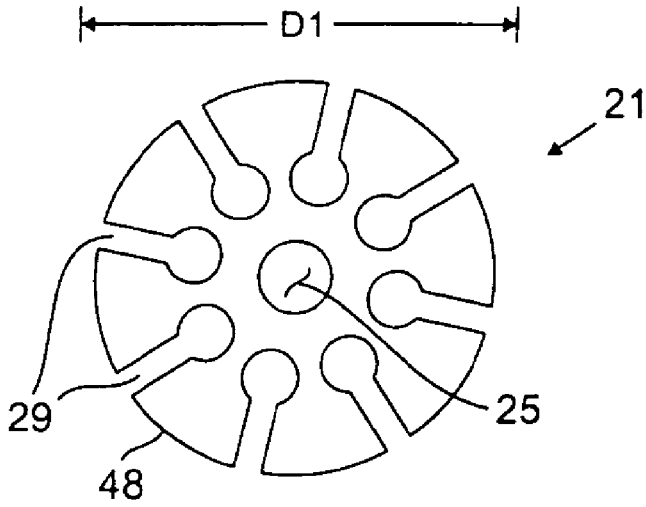
FIG. 3 is a top plan view of a deflector element for use in the fire protection sprinkler of FIG. 1.

Referring to FIG. 3, a deflector 21 of the invention for use in pendent-type fire protection sprinkler 10 has an outside diameter, $D_1$, e.g., a uniform value of about 1.75 inches. The deflector 30 has a thickness of about 0.09 inch, and it is fabricated from a phosphor bronze alloy UNS52100, per ASTM BI03, with a Rockwell B Scale hardness of about 92. The diameter of deflector 21 is optimized to provide, from a predetermined height, a particular spray pattern over a desired area to be protected from fire. The outside diameter is limited by the volume of fire retardant fluid, and by the size of the orifice. Moreover, where cost is a consideration, increasing the size of the deflector diameter requires the thickness of deflector 21 to be increased in order to ensure that it has sufficient rigidity to withstand the force of the discharged stream of fluid.

The deflector 21 has an inside surface 38 (FIG. 1) downstream of, and facing towards, i.e. opposing, the deflector outlet 18, and an outside surface 46 (FIG. 1) on the opposite side of the deflector, i.e. facing away from the deflector outlet. The inside surface of the deflector 21 includes a substantially flat, central base area 48 (FIGS. 3 and 5A) having a central hole 25 for mounting to the apex element 26.

A grouping of equally spaced reentrant slots 29, e.g. at least about four, and preferably about eight, as shown in FIG. 3, are symmetrically located about the periphery of the deflector through the body of the deflector 21, i.e. from the inside surface to the opposite outside surface of the deflector. The radially innermost portions of the reentrant slots are substantially in line axially with the outer peripheral surface 27 (FIG. 2) of the apex element 26 of the sprinkler frame, or extend beneath, i.e. underlie, in the direction of fire retardant fluid flow, the outermost surface apex element 26, as shown in FIG. 2.

With this arrangement, it has been found that a relatively greater quantity of fire retardant fluid can be diverted to produce a relatively greater amount of thrust in the inner, downwardly-directed portion (i.e., the central core) of the spray pattern at lower pressures, as compared to the amount of central core thrust generated by prior art deflectors, e.g. those having straight slots or slots which are slightly tapered in a direction radially outward from the deflector axis.

Figure 4:
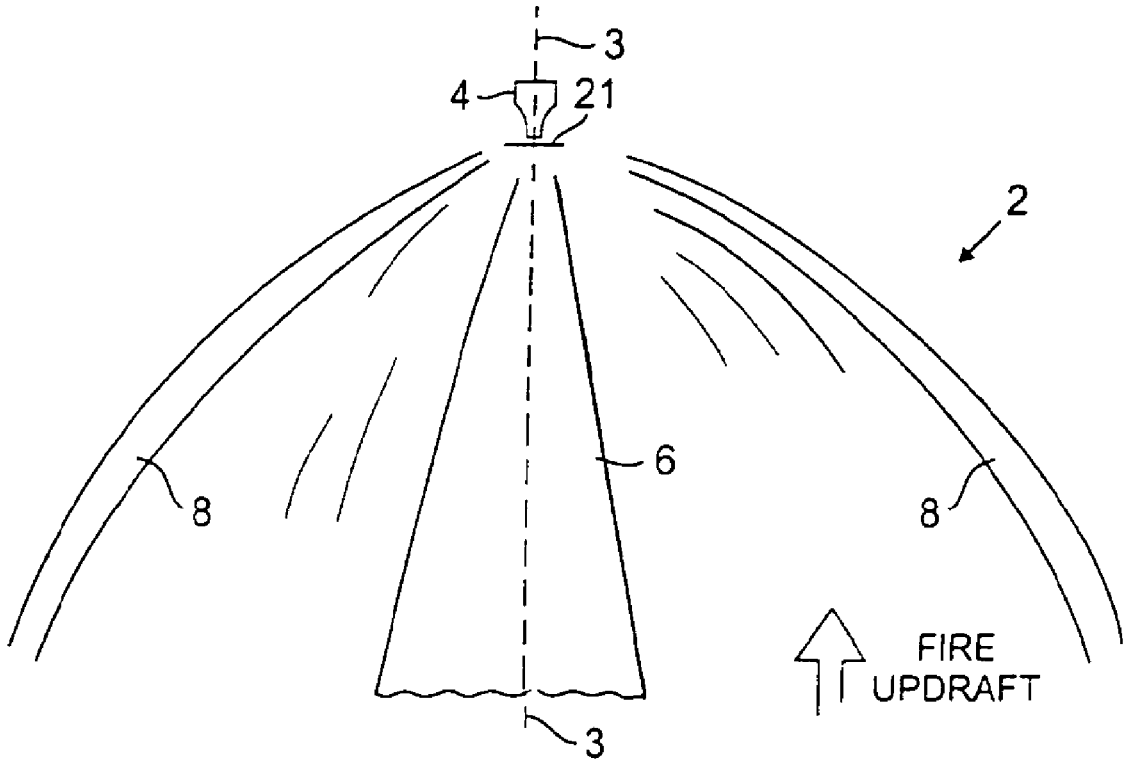
FIG. 4 illustrates a spray pattern for a fire protection sprinkler having a deflector with reentrant slots.

Referring to FIG. 4, a spray pattern for a commercial ESFR fire protection sprinkler with the deflector 21 having reentrant slots 27 is illustrated. The reentrant slots 27 result in a spray pattern 2 in which the spray direction is altered towards a center main axis 3 of a sprinkler 4. In particular, the reentrant slots 27 of the deflector result in formation of a central core 6 of spray pattern 2, with tines of the deflector resulting in formation of an outer shell 8 of spray pattern 2. In particular, the central core portion 6 of the spray pattern 2 has fluid droplets with greater momentum (i.e. mass times velocity), at relatively lower inlet pressures, than provided by prior art sprinklers of similar purpose.

As will be described in greater detail below, in other ESFR sprinkler applications, it may be desired to alter the spray pattern to provide additional concentrations of fluid spray, e.g., other than the central core and outer umbrella-shaped portions.

Figure 5:
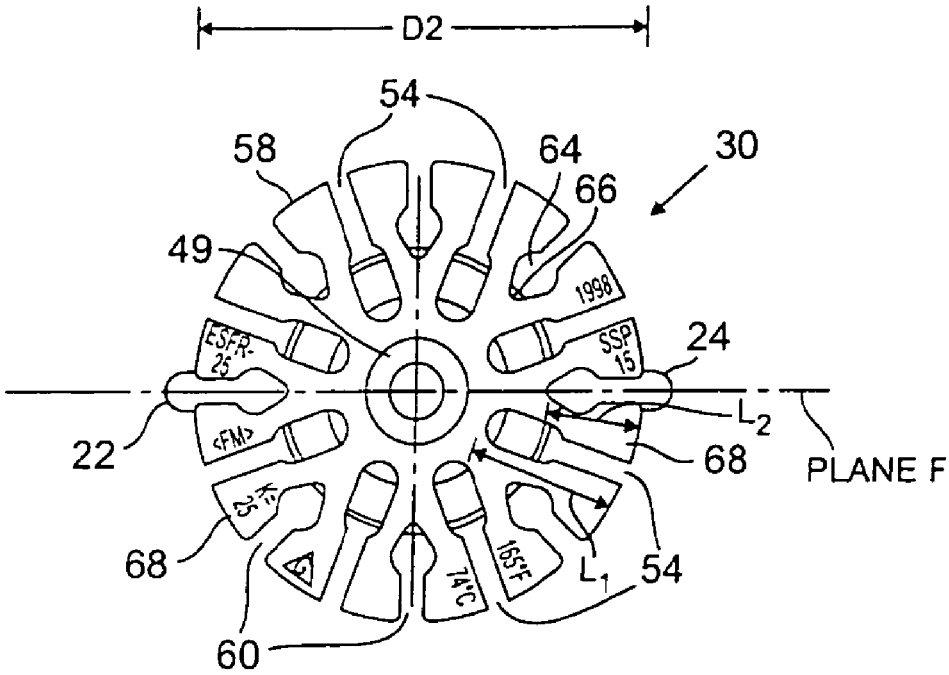
FIG. 5 is a top plan view of an alternate embodiment of a deflector element for use in the fire protection sprinkler of FIG. 1.

For example, referring to FIG. 5, the deflector 30 of the deflector impingement-type, automatic fire protection sprinkler 10 of the invention has an outside diameter, $D_2$, e.g., a uniform value of about 1.75 inches. The deflector 30, having a thickness, T (FIG. 1), e.g. about 0.09 inch, is fabricated from a phosphor bronze alloy UNS52100, per ASTM B103, with a Rockwell Scale B hardness of about 92.

Referring again to FIG. 5, as well as to FIG. 2, deflector 30 has an inside surface 38 downstream of, and facing towards, i.e. opposing, the nozzle outlet 18, and an outside surface 46 on the opposite side of the deflector, i.e. facing away from the nozzle outlet. The inside surface 38 of the deflector 30 includes a substantially flat, central base area 48 having a central hole 49 for mounting to the apex element 26.

Figure 5A:
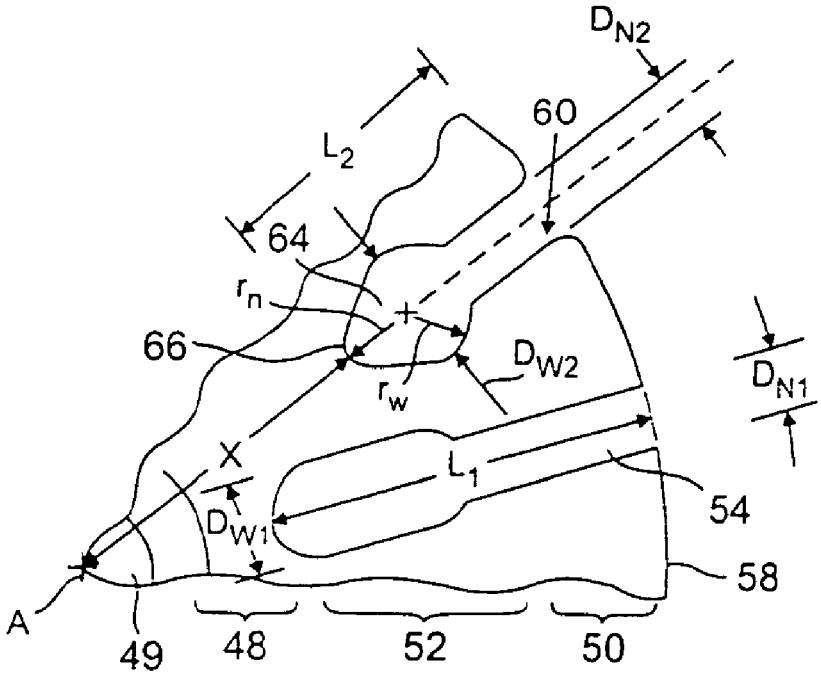
FIG. 5A is a similar enlarged view of the region A-A of FIG. 5.

Referring particularly to FIGS. 5 and 5A, a first grouping of a first type of equally spaced reentrant slots 54, e.g., preferably at least one pair of generally opposing reentrant slots, more preferably at least two pairs of generally opposing slots, and most preferably about four pairs of generally opposing slots, are symmetrically located around the periphery of deflector 30 and extend from the inside surface 38 to the opposite outside surface 46, and thus through the body of the deflector 30. Each reentrant slot 54 extends a radial length $L_1$, e.g., in the range of about 0.52 inch to about 0.62 inch, and preferably about 0.57 inch, from an outer peripheral edge 58 of the deflector inward towards base area 48. The reentrant slots 54 are elongated in shape and angularly spaced from each other in a range between about 40° to 50° and preferably, as shown here, the angular spacing is about 45°. Further, the elongated reentrant slots 54 have a first width, $D_{n1}$, measured transversely to the slot centerline in a region of the peripheral edge 58, in the range of about 0.08 inch to 0.010 inch, and preferably about 0.09 inch, and a second width, $D_{w1}$, measured transversely to the slot centerline in a region spaced inwardly from the peripheral edge, in the range of about 0.13 inch to 0.17 inch, and preferably about 0.15 inch.

A second grouping of a second type of equally spaced reentrant slots 60 (e.g., preferably at least one pair of generally opposing slots, more preferably at two pairs of generally opposing slots, and most preferably at least four pairs of generally opposing slots, as shown in FIG. 5) are symmetrically positioned between adjacent reentrant slots 54. Referring also to FIG. 5A, like reentrant slots 54, reentrant slots 60 extend from inside surface 38 to opposite outside surface 46, through the body of deflector 30. Moreover, reentrant slots 60 extend from outer peripheral edge 58 of the deflector towards base area 48 by a radial length $L_2$, e.g., in the range of about 0.32 inch to about 0.42 inch, and preferably about 0.37 inch. Reentrant slots 60 are preferably pear-shaped and extend into an intermediate region 52, with a relatively wider end 64 of each reentrant slot 60 having a radius, $r_w$, e.g., in the range of about 0.04 inch to about 0.08 inch, and preferably about 0.06 inch. The innermost, narrower end 66 of each slot 60, located relatively closer to the deflector axis, A, than the wider portion 64, has a radius, $r_n$, e.g., in the range of about 0.04 inch to about 0.06 inch, and preferably about 0.05 inch. Reentrant slots 60 are angularly spaced from each other in the range of between about 40° to 50° and preferably, as shown here, the angular spacing is about 45°. Further, the generally triangular-shaped or, more specifically, pear-shaped reentrant slots 60 have a first width, $D_{m2}$, measured transversely to the slot centerline in a region of the peripheral edge 58, in the range of about 0.08 inch to 0.10 inch, and preferably about 0.09 inch, and a second width, $D_{w2}$, measured transversely to the slot centerline in a region spaced inwardly from the peripheral edge, in the range of 0.16 inch to 0.20 inch, and preferably about 0.18 inch.

Tines 68 are defined by that portion of the deflector body extending from central base area 48 and including those regions between reentrant slots 54 and reentrant slots 60. The shape of reentrant slots 60 is somewhat dependent on the shape of reentrant slots 54. In particular, the pear-shape of reentrant slots 60 ensures that the width of tines 68 between reentrant slots 54 and 60 is sufficient to provide the desired structural rigidity to the deflector body, as well as to facilitate manufacture of the body, e.g., when stamped or machined.

Figure 6:
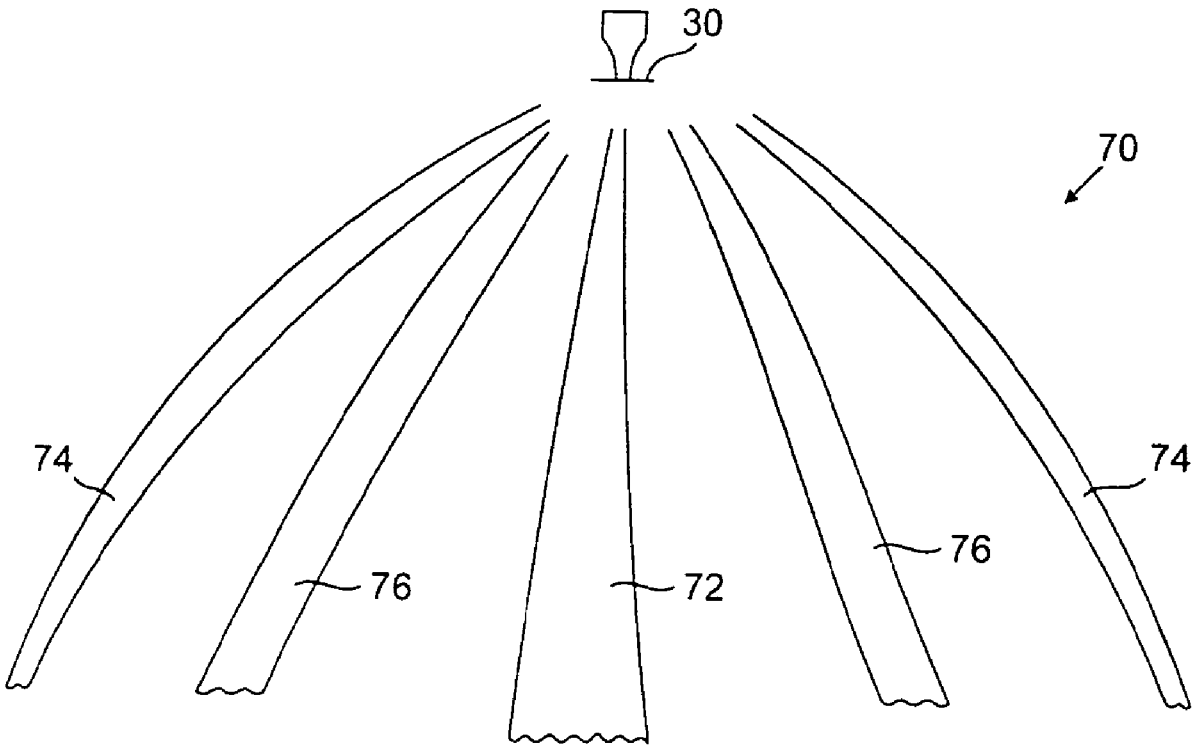
FIG. 6 illustrates a spray pattern provided by the fire protection sprinkler using the deflector element of FIG. 5.

Referring to FIG. 6, in operation, a stream of fire retardant fluid, e.g. water, from the outlet 18 impacting upon the opposed, inside surface 38 of the deflector 30 is diverted generally radially downward and outward by the deflector, being broken into a spray pattern consisting of a superimposed combination of an outer, umbrella-shaped pattern component, an intermediate, componentized spray pattern component, and an inner, generally conical-shaped pattern component, the configuration of the spray pattern being primarily a function of deflector design.

Referring to FIG. 6, and in contrast to FIG. 4, automatic fire protection sprinkler 10 having deflector 30, in operation, provides a spray pattern 70 well-suited for ESFR sprinkler applications. In particular, reentrant slots 54 cause the spray to form a central core 72, tines 68 cause the spray to form an outer shell 74, and reentrant slots GO cause the spray to form secondary thrust regions 76 in an intermediate zone, between central core 72 and outer shell 74, of the spray pattern 70.

In addition, referring again to FIG. 5, in a preferred embodiment, deflector 30 is positioned with a pair of reentrant slots 60 disposed in plane, F, of the sprinkler frame arms 22, 24.

A commercial embodiment of the automatic fire protection sprinkler 10 of the invention is represented by a 25.2 K-Factor, Model ESFR-25™ pendent sprinkler assembly, available from Grinnell Corporation, 3 Tyco Park, Exeter, N.H. 03833.

The 25.2 K-Factor, Model ESFR-25™ pendent sprinkler is listed and approved by Factory Mutual Research Corporation (FM) as an "Early Suppression Fast Response Pendent Sprinkler" designed for use with wet pipe, automatic sprinkler systems for the fire protection of high-piled storage. The Model ESFR-25™ pendent sprinkler is a suppression mode sprinkler, and its use is especially advantageous as a means for eliminating use of in-rack sprinklers. Acceptable storage arrangements which can be protected by the Model ESFR-25™ pendent sprinkler include open-frame single-row rack, double-row rack, multiple-row rack, and portable rack storage, as well as palletized and solid-piled storage, of most encapsulated or non-encapsulated, common materials including cartoned unexpanded plastics. In addition, the protection of some storage arrangements of roll paper and rubber tires can be considered as well.

The FM listing and approval of the Model ESFR-25™ pendent sprinkler permits it to be used to protect encapsulated and non-encapsulated, Class I, II, III and IV, as well as cartoned unexpanded plastics, at design pressures based on maximum storage and ceiling heights, as shown in Table I, below.

TABLE I

| Maximum Storage Height, Ft. (m) | Maximum Ceiling Height, Ft. (m) | Minimum Flowing Pressure, psi (bar) |
|---|---|---|
| 40 (12.2) | 45 (13.7) | 50 (3.4) |
| 35 (10.7) | 40 (12.2) | 40 (2.7) |
| 30 (9.1) | 35 (10.7) | 30 (2.1) |
| 25 (7.6) | 30 (9.1) | 20 (1.4) |

The FM listing and approval of the Model ESFR-2S™ pendent sprinkler permits it to be used to protect heavy and medium weight paper storage, as indicated in Table II, below. These guidelines are applicable to banded or unbanded rolls in open, standard, or closed array. The design includes a hose stream allowance of 250 gpm (950 1 pm), and the water supply duration is to be a minimum of 1 hour.

TABLE II

| Maximum Storage Height, Ft. (m) | Maximum Ceiling Height, Ft. (m) | Minimum Flowing Pressure, psi (bar) |
|---|---|---|
| | Heavy Weight | |
| 25 (7.6) | 30 (9.1) | 20 (1.4) |
| 30 (9.1) | 40 (12.2) | 40 (2.7) |
| 30 (9.1) | 45 (13.7) | 50 (3.4) |
| | Plastic Coated Heavy Weight | |
| 20 (6.1) | 30 (9.1) | 20 (1.4) |
| 20 (6.1) | 40 (12.2) | 40 (2.7) |
| | Medium Weight | |
| 20 (6.1) | 30 (9.1) | 20 (1.4) |
| 20 (6.1) | 40 (12.2) | 40 (2.7) |

The FM listing and approval of the Model ESFR25™ pendent sprinkler also permits its use for protection of on-side and on-tread (not interlaced) storage of rubber tires in open frame racks to a maximum height of 25 feet (7.6 m) under ceilings no higher than 30 feet (9.1 m). The sprinkler system must be designed to supply twelve sprinklers at 20 psi (1.4 bar), flowing four sprinklers per branch on three branch lines. Sprinklers must be rated 165°/74° C. All other guidelines of FM Loss Prevention Data Sheet 2-2 must be followed, except that the hose stream demand must be 500 gpm (1900 1 pm) and the water supply duration must be a minimum of 2 hours.

The 25.2 K-Factor, Model ESFR-25™ pendent sprinkler is also listed by Underwriters Laboratories Inc. (UL) and by UL for use in Canada (C-UL) as a "Specific Application Early Suppression Fast Suppression Sprinkler" for use in accordance with NFPA 13, NFPA 231, and NFPA 231C (the complete disclosures of each of which are incorporated herein by reference) to protect single-row rack, double-row rack, and multiple row rack storage (no open top containers or solid shelves) and palletized and solid pile storage (no open containers or solid shelves), of most encapsulated or non-encapsulated, common (Class I, II, III and IV commodities) materials, including cartoned unexpanded plastics, when installed with the maximum ceiling and storage heights and minimum design pressures shown in Table III, below.

TABLE III

| Maximum Storage Height, Ft. (m) | Maximum Ceiling Height, Ft. (m) | Minimum Flowing Pressure, psi (bar) |
|---|---|---|
| 40 (12.2) | 45 (13.7) | 40 (2.7) |
| 35 (10.7) | 40 (12.2) | 25 (1.7) |
| 30 (9.1) | 35 (10.7) | 20 (1.4) |
| 25 (7.6) | 30 (9.1) | 15 (1.0) |

In particular, the Model ESFR-25™ pendent sprinkler is designed to operate at substantially lower end head pressures, as compared to ESFR sprinklers having a nominal K-Factor of 14. This feature offers flexibility when sizing the system piping, as well as possibly reducing or eliminating the need for a system fire pump. Also, the Model ESFR-25™ pendent sprinkler permits use of a maximum deflector-to-ceiling distance of 18 inches (460 mm), as compared to a maximum of 14 inches (360 mm) for ESFR sprinklers with a K-factor of 14.

Using a Model ESFR-25™ pendent sprinkler assembly, data was collected for comparison of fluid densities released over an area representing the top of stacked commodities, e.g., boxes, in a warehouse setting.

Referring to FIGS. 7-10, the test area is shown as a pictorial array defining 0.5 meter square regions 90 representing the top surfaces of the stacked commodities, surrounded by flue regions 92, i.e., spaces between the stacked commodities, e.g., about six inches wide. A discharging sprinkler 94 is centrally located at point 96. The vertical distance between the sprinkler deflector and the top of the fluid collector area is 8 feet, 6 inches.

In each region there is shown a fluid density value representing the actual measured amount of fluid volume, in gallons per minute per square foot, falling within that region. The fluid density values are employed to determine weighted average values of ADD (Actual Delivered Density) over different regions of the array. Of particular interest is the region identified as "central core ADD" which represents a weighted average of the central sixteen square regions 90 and the four flue regions surrounding point 96.

Figure 7:
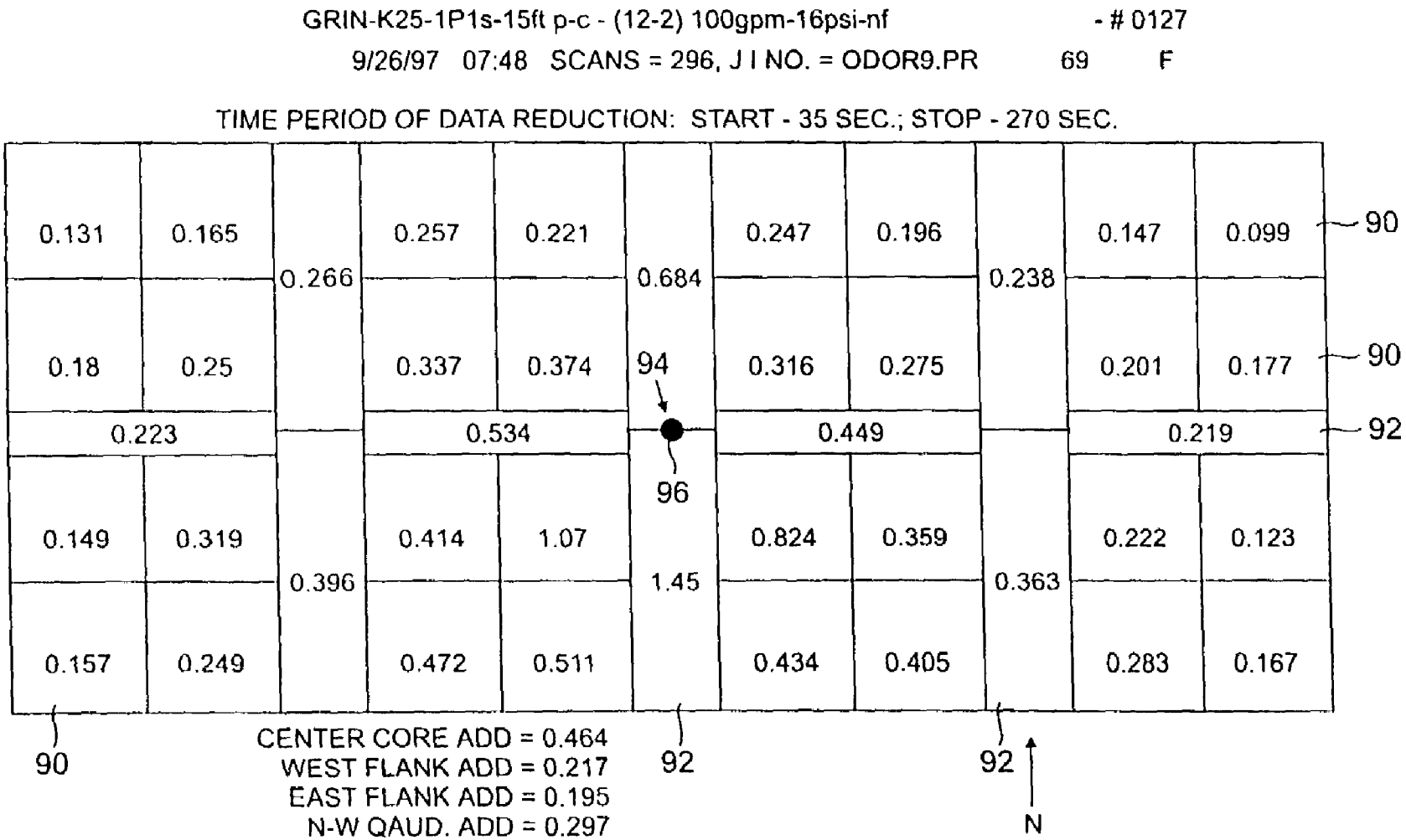
FIG. 7 PRIOR ART
FIG. 7 is a chart of ADD test data in a no-fire, water spray only condition for a typical straight-slotted deflector.
Figure 8:
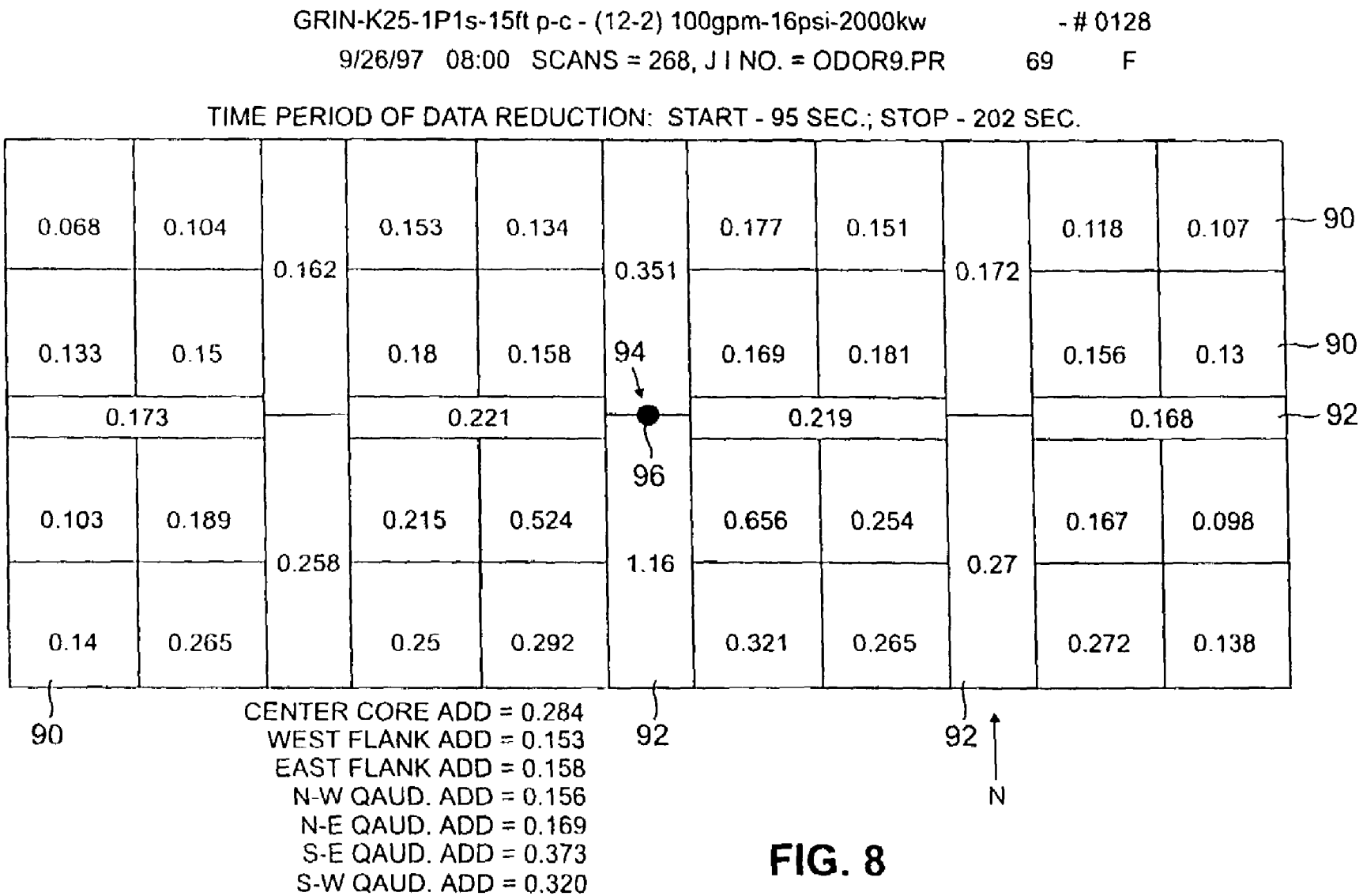
FIG. 8 PRIOR ART
FIG. 8 is a chart of ADD test data with a simulated 2,000 kw fire located directly beneath the primary axis of the sprinkler for the same typical straight-slotted deflector.

Referring to FIG. 7, fluid density data collected using a conventional (prior art) deflector affixed to a 25.2 K-factor sprinkler with straight slots in a no-fire, water spray only condition is shown. FIG. 8 shows the fluid density data collected using the same straight-slotted deflector design in a 2,000 kw fire located directly below the primary vertical axis of the discharging 25.2 K-factor sprinkler 94. The data shows that a substantial reduction in the collected densities of fire protection fluid occurs when the sprinkler is tested with a 2,000 kw fire.

Figure 9:
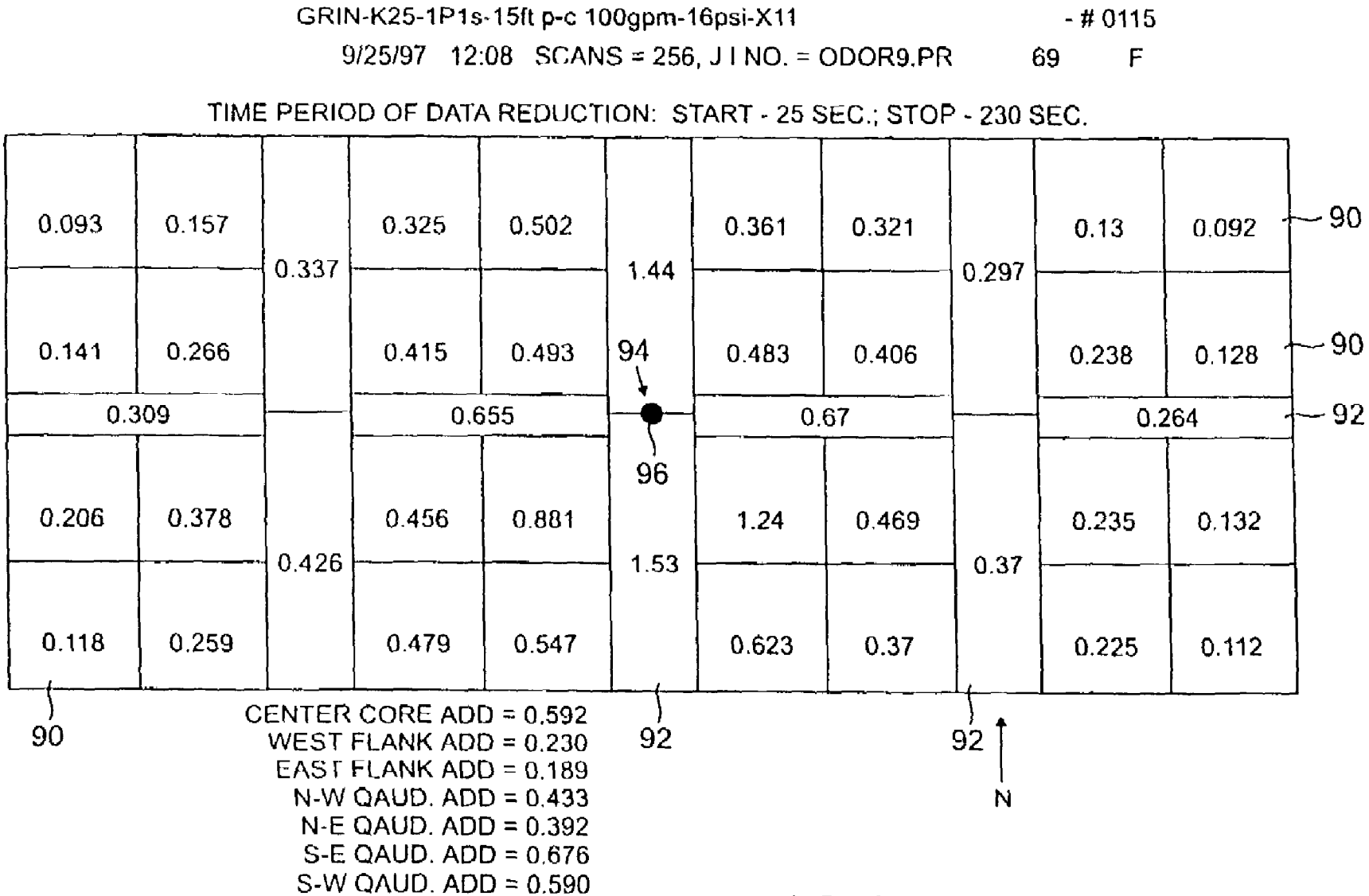
FIG. 9 is a chart of ADD test data in a no-fire, water spray only condition using a sprinkler having a deflector in accordance with the invention.
Figure 10:
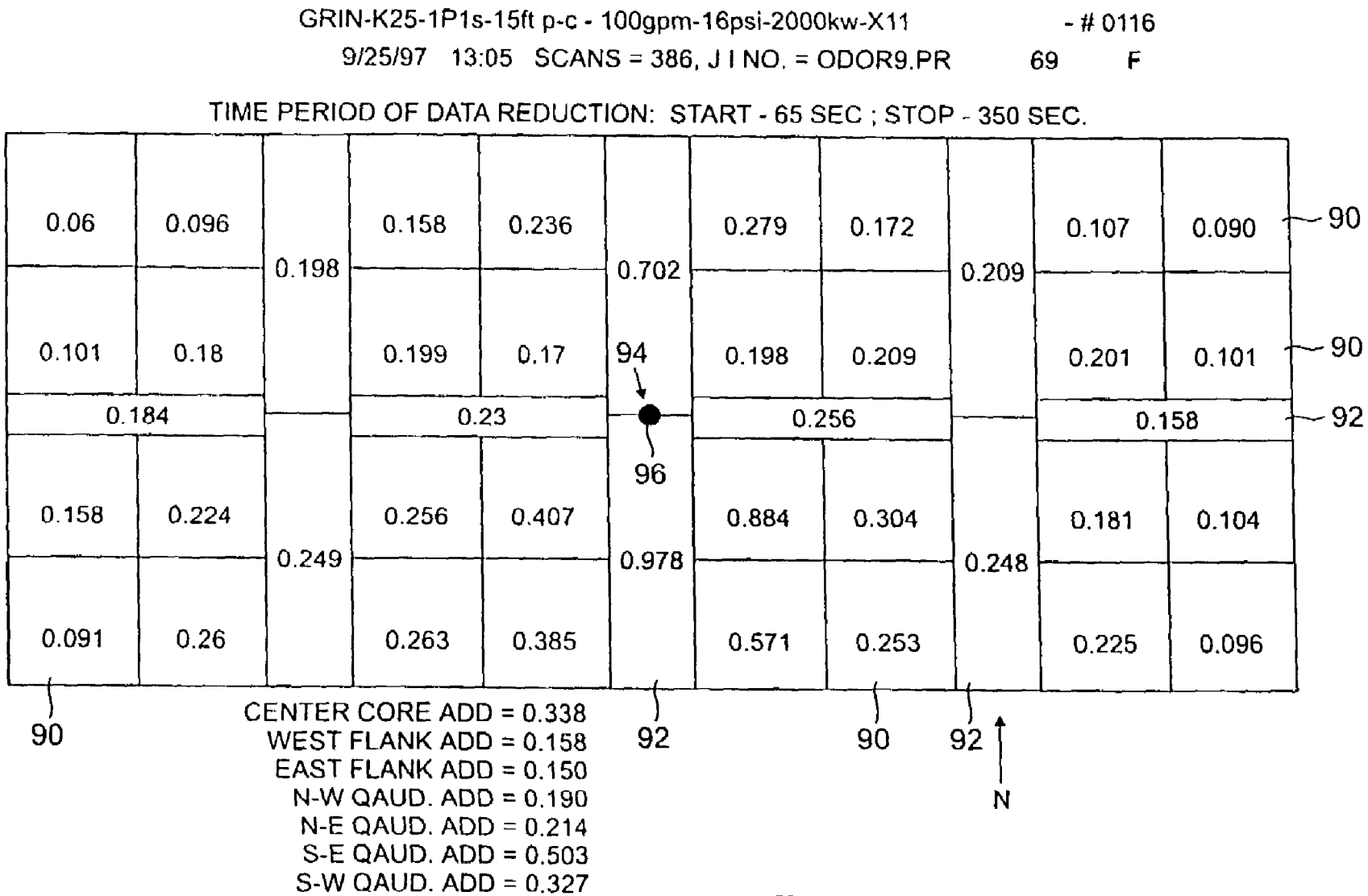
FIG. 10 is a chart of ADD test data with a simulated 2,000 kw fire located directly beneath the primary axis of the sprinkler using a sprinkler having a deflector in accordance with the invention.

Referring to FIGS. 9 and 10, fluid density data collected using a 25.2 K-factor fire protection sprinkler with a deflector 30 in accordance with the invention is shown. In particular, FIG. 9 represents collected data in the no-fire, water spray only condition and FIG. 10 represents collected data in the 2,000 kw fire condition. The aforementioned tests were conducted under identical pressure and flow conditions. Of particular interest is the substantial increase in center core ADD provided by the sprinkler having the deflector 30 of the invention, as compared to the conventional straight-slotted deflector. Moreover, this increase in center core ADD performance is achieved with substantially no sacrifice in performance at peripheral regions.

Another type of water distribution test, the so-called "10 Pan Distribution Test," such as that described in the Apr. 8, 1997, edition of UL 199, Standard for Automatic Sprinklers for Fire-Protection Service, the complete disclosure of which is incorporated herein by reference, provides another means for describing the benefit of use of reentrant slots and, in particular, the reentrant slots 60 of the deflector 30 of this invention. Referring to FIG. 30.1 of the Apr. 8, 1997 edition of UL 199, with a 25.2 K-factor conventional (prior art) sprinkler having straight slots and in a no-fire, water spray only condition, an average water density of about 0.82 gallon per minute per square foot was measured in the 1 foot long by 1 foot wide pan centered at a 3 foot radius from the primary vertical axis of the sprinkler when it was flowing 100 gallons per minute. By comparison, with a 25.2 K-factor fire protection sprinkler having a deflector 30 in accordance with the invention, an average water density of about 1.3 gallons per minute per square foot was measured in the 1 foot long by 1 foot wide pan centered at a 3 foot radius from the primary vertical axis of the sprinkler when it was flowing 100 gallons per minute.

Other embodiments are within the following claims. For example, the outlet 18 may have a non-circular cross-section The sprinkler 10 may have a K-factor in the range of about 8.0 to 50.0, preferably in the range from about 14.0 to 30.0, more preferably in the range of about 22.0 to about 28.0, and most preferably the K-factor is about 25.0.

Deflectors of the invention having one group of reentrant slots, e.g. slots 27 of deflector 21 (FIG. 3), may have slots of different lengths. In deflectors of the invention having two groups of reentrant slots, e.g. slots 54, 60 of deflector 30 (FIG. 5), slots within each group of slots may also have different lengths, and/or a third set of reentrant slots or holes may be employed to provide a different spray pattern. In deflectors of the invention having three groups of reentrant slots, the slots may be arranged in a pattern such as abcbabcba. The numbers of reentrant slots in each group also may vary. Moreover, the slots need not extend radially to the periphery of the deflector but may be provided in non-radial arrangements.

The peripheral edge 58 of the outer area 50 of the deflector 30 may define ridges in the radial outward direction from the deflector axis. Although deflector 30 is described above as a plate-like member, the deflector need not be flat but may, e.g., be wavy or frusto-conical in shape. The deflector 30 may also have variations in the shape and dimensions of the reentrant slots 60 through the intermediate region 52 of the deflector inner surface 38, e.g., referring also to FIG. 5A, in length, $L_2$, radius, $r_n$, and/or radius, $r_w$, and/or radial spacing, X, from the deflector axis, A. Frame arms 22, 24 can have a wide variety of shapes, mounting or support arrangements, e.g., the deflector 30 may be positioned inside, rather than outside, frame arms 22, 24, and the frame arms may be affixed to the deflector 30, rather than to the apex element 26.

The apex element 26 need not be generally conically-shaped, as shown in FIG. 2, but may be curved in the direction of the orifice axis, e g, to achieve specific water distribution objectives. Opposing vertical sides of the reentrant slots may not be identical.

All of the above are applied without departing from the spirit and scope of this invention.

What is claimed:

1. An early suppression fast response pendent-type fire protection sprinkler comprising:

a sprinkler body defining an orifice and an outlet for delivering a flow of fluid from a source, the sprinkler body having a K-factor of about 25;

a pair of opposed arms disposed on a plane, each of the arms having a first end extending from the body and a second end distal the body;

an apex joined to the second end of each of the arms, the apex having a first end and a second end, the second end being wider than the first end, the apex having an outer peripheral surface extending between the first and second end;

a plug that closes the outlet;

a thermally responsive element that supports the plug; and a deflector having a central deflector axis, the deflector being coupled to the apex so that the second end of each of the pair of arms is disposed between the deflector and the outlet of the body with the apex being centrally disposed along the deflector axis and the second end of the apex adjacent the deflector, the deflector having a first surface opposed to the flow of fluid from the outlet to deflect the flow of fluid to suppress a fire in at least one of a single row rack storage, double row rack storage and multiple row rack storage having a maximum storage height of 25 feet in a storage area having a maximum ceiling height of 30 feet, with no open containers and no solid shelves, the deflector defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector radially inward to an innermost portion of the slot so as to define a slot length extending along a slot centerline, the slot length of the slots in one grouping varying from the slot lengths of the slots in another grouping of the at least two grouping of slots, each slot of one grouping of the at least two groupings of slots having a first width generally transverse to the slot centerline of the slot of the one grouping, each slot of another grouping of the at least two groupings of slots having a second width different than the first width and generally transverse to the slot centerline of the slot of the other grouping, at least one of the at least two grouping of slots having at least four slots disposed to one side of the plane, the other of the at least two grouping of slots having at least three slots disposed to one side of the plane, each slot of one grouping of the at least two groupings of slots having the innermost portion no further outward from the deflector axis than the peripheral surface of the apex, each slot of the other grouping of slots having the innermost portion further outward from the deflector axis than the peripheral surface of the apex, the at least two grouping of slots being disposed so that the fluid flow is distributed in a pattern such that the sprinkler has a minimum design flowing pressure of 15 pounds per square inch and provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the axis.

2. An early suppression fast response pendent-type fire protection sprinkler comprising:

a sprinkler body defining an orifice and an outlet for delivering a flow of fluid from a source, and having a K-factor of about 25;

a pair of opposed arms disposed on a plane, each of the arms having a first end extending from the body and a second end distal the body;

an apex joined to the second end of each of the arms, the apex having a first end and a second end, the second end being wider than the first end, the apex having an outer peripheral surface extending between the first and second end;

a plug that closes the outlet of the body;

a thermally responsive element that supports the plug; and a deflector having a central deflector axis, the deflector being coupled to the apex so that the second end of each of the arms is disposed between the deflector and the outlet of the body with the apex being centrally disposed along the deflector axis and the second end of the apex adjacent the deflector, the deflector having a first surface opposed to the flow of fluid from the outlet to deflect the flow of fluid to suppress a fire in at least one of a single row rack storage, double row rack storage and multiple row rack storage having a maximum storage height of 30 feet in a storage area having a maximum ceiling height of 35 feet, with no open containers and no solid shelves, the deflector defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector radially inward to an innermost portion of the slot so as to define a slot length extending along a slot centerline, the slot length of the slots in one grouping varying from the slot lengths of the slots in another grouping of the at least two grouping of slots, each slot of one grouping of the at least two groupings of slots having a first width generally transverse to the slot centerline of the slot in the one grouping, each slot of another grouping of the at least two groupings of slots having a second width different than the first width and generally transverse to the slot centerline of the slot in the other grouping, at least one of the at least two grouping of slots having at least four slots disposed to one side of the plane, the other of the at least two grouping of slots having at least three slots disposed to one side of the plane, at least one pair of slots of one grouping of the at least two groupings of slots having the innermost portion no further outward from the deflector axis than the peripheral surface of the apex, each slot of the other grouping of slots having the innermost portion further outward from the deflector axis than the peripheral surface of the apex, the at least two grouping of slots being disposed so that the fluid flow is distributed in a pattern such that the sprinkler has a minimum design flowing pressure of about 20 pounds per square inch, and provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

3. An early suppression fast response pendent-type fire protection sprinkler comprising:

a sprinkler body defining an orifice and an outlet for delivering a flow of fluid from a source, and having a K-factor of about 25;

a pair of opposed arms disposed on a plane, each of the pair of arms having a first end extending from the body and a second end distal the body;

an apex joined to the second end of each of the arms, the apex having a first end and a second end, the second end being wider than the first end, the apex having an outer peripheral surface extending between the first and second end;

a plug that closes the outlet of the body;

a thermally responsive element that supports the plug; and a deflector having a central deflector axis, the deflector being coupled to the apex so that the second end of each of the arms is disposed between the deflector and the outlet of the body with the apex being centrally disposed along the deflector axis and the second end of the apex adjacent the deflector, the deflector having a first surface opposed to the flow of fluid from the outlet to deflect the flow of fluid to suppress a fire in at least one of a single row rack storage, double row rack storage and multiple row rack storage having a maximum storage height of 35 feet in a storage area having a maximum ceiling height of 40 feet, with no open containers and no solid shelves, the deflector defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector radially inward to an innermost portion of the slot so as to define a slot length extending along a slot centerline, the slot length of the slots in one grouping varying from the slot lengths of the slots in another grouping of the at least two grouping of slots, each slot of one grouping of the at least two groupings of slots having a first width generally transverse to the slot centerline of the slot of the one group, each slot of another grouping of the at least two groupings of slots having a second width different than the first width and generally transverse to the slot centerline of the slot of the other group, at least one of the at least two grouping of slots having at least four slots disposed to one side of the plane, the other of the at least two grouping of slots having at least three slots disposed to one side of the plane, at least one pair of slots of one grouping of the at least two groupings of slots having the innermost portion no further outward from the deflector axis than the peripheral surface of the apex, each slot of the other grouping of slots having the innermost portion further outward from the deflector axis than the peripheral surface of the apex, the at least two grouping of slots being disposed so that the fluid flow is distributed in a pattern such that the sprinkler has a minimum design flowing pressure of about 25 pounds per square inch, and provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

4. An early suppression fast response pendent-type fire protection sprinkler comprising:

a sprinkler body defining an orifice and an outlet for delivering a flow of fluid from a source, and having a K-factor of about 25;

a pair of opposed arms disposed on a plane, each of the arms having a first end extending from the body and a second end distal the body;

an apex joined to the second end of each of the arms, the apex having a first end and a second end, the second end being wider than the first end, the apex having an outer peripheral surface extending between the first and second end;

a plug that closes the outlet;

a thermally responsive element that supports the plug; and a deflector having a central deflector axis, the deflector being coupled to the apex so that the second end of each of the arms is disposed between the deflector and the outlet of the body with the apex being centrally disposed along the deflector axis and the second end of the apex adjacent the deflector, the deflector having a first surface opposed to the flow of fluid from the outlet to deflect the flow of fluid to suppress a fire in at least one of a single row rack storage, double row rack storage and multiple row rack storage having a maximum storage height of 40 feet in a storage area having a maximum ceiling height of 45 feet, with no open containers and no solid shelves, the deflector defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector radially inward to an innermost portion of the slot so as to define a slot length extending along a slot centerline, the slot length of the slots in one grouping varying from the slot lengths of the slots in another grouping of the at least two grouping of slots, each slot of one grouping of the at least two groupings of slots having a first width generally transverse to the slot centerline of the slot of the one grouping, each slot of another grouping of the at least two groupings of slots having a second width different than the first width and generally transverse to the slot centerline of the slot of the other group of slots, at least one of the at least two grouping of slots having at least four slots disposed to one side of the plane, the other of the at least two grouping of slots having at least three slots disposed to one side of the plane, at least one pair of slots of one grouping of the at least two groupings of slots having the innermost portion no further outward from the deflector axis than the peripheral surface of the apex, each slot of the other grouping of slots having the innermost portion further outward from the deflector axis than the peripheral surface of the apex, the at least two grouping of slots being disposed so that the fluid flow is distributed in a pattern such that the sprinkler has a minimum design flowing pressure of about 40 pounds per square inch, and provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

5. An early suppression fast response pendent-type fire protection sprinkler comprising:

a sprinkler body defining an orifice and an outlet for delivering a flow of fluid from a source, and having a K-factor of greater than 16;

a pair of opposed arms disposed on a plane, each of the arms having a first end extending from the body and a second end distal the body;

an apex joined to the second end of each of the arms, the apex having a first end and a second end, the second end being wider than the first end, the apex having an outer peripheral surface extending between the first and second end;

a plug that closes the outlet of the body;

a thermally responsive element that supports the plug; and a deflector having a central deflector axis, the deflector being coupled to the apex so that the second end of each of the arms is disposed between the deflector and the outlet of the body with the apex being centrally disposed along the deflector axis and the second end of the apex adjacent the deflector, the deflector having a first surface opposed to the flow of fluid from the outlet to deflect the flow of fluid to suppress a fire in at least one of a single row rack storage, double row rack storage and multiple row rack storage having a maximum storage height of 20 to 40 feet in a storage area having a maximum ceiling height of 45 feet, with no open containers and no solid shelves, the deflector defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector radially inward to an innermost portion of the slot so as to define a slot length extending along a slot centerline, the slot length of the slots in one grouping varying from the slot lengths of the slots in another grouping of the at least two grouping of slots, each slot of one grouping of the at least two groupings of slots having a first width generally transverse the slot centerline of the slot of the one group, each slot of another grouping of the at least two groupings of slots having a second width different than the first width and generally transverse to the slot centerline of the slot of the other group, at least one of the at least two grouping of slots having at least one radial slot disposed to one side of the plane, the other of the at least two grouping of slots having at least two radial slots disposed to one side of the plane, at least one pair of slots of one grouping of the at least two groupings of slots having the innermost portion no further outward from the deflector axis than the peripheral surface of the apex, each slot of the other grouping of slots having the innermost portion further outward from the deflector axis than the peripheral surface of the apex, the at least two grouping of slots being disposed so that the fluid flow is distributed in a pattern such that the sprinkler has a design flowing pressure of 15-50 pounds per square inch, and provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

6. An early suppression fast response pendent-type fire protection sprinkler comprising:

a sprinkler body defining an orifice and an outlet for delivering a flow of fluid from a source, and having a minimum design flowing pressure of about 15 pounds per square inch;

at least one frame arm disposed in a plane having a first end extending from the body and a second end distal of the body; and means for providing ESFR protection to rack storage located beneath a ceiling having a maximum ceiling height up to about 30 feet, the rack storage being without any in rack sprinkler, solid shelves or open-top containers, the rack storage being any one of single-row, double-row and multiple-row rack, the rack storage including commodity having a maximum storage height of about 25 feet, the means including:

an apex joined to the second end of the at least one frame arm, the apex having a first end, a second end, and a peripheral surface extending between the first and second end of the apex; and a deflector coupled to the apex so that the second end of the at least one frame arm is located between the outlet of the body and the deflector, the deflector having a first surface opposed to the outlet to deflect a flow of fluid from the outlet of the sprinkler body and an outer peripheral edge, the deflector defining a first group and a second group of slots disposed about a deflector axis, at least one of the first and second group of slots having four pairs of opposed slots, each of the slots in each of the first and second group of slots extend from the first surface through the deflector and from slot openings at an outer peripheral edge of the deflector radially inward to an innermost portion of the slot, each slot of the first group of slots having a first width generally transverse to a first radial length extending perpendicular to the deflector axis, at least one pair of opposed slots in the first group of slots each having a radial length between about 0.52 inches to about 0.62 inches, each slot of the second group of slots having a second width different than the first width and generally transverse to a second radial length extending perpendicular to the deflector axis that is different than the first radial length, at least one pair of opposed slots in the second group of slots each having their second radial length between about between 0.32 to about 0.42 inches, at least one pair of slots in the first group of slots being angularly spaced from each other in a range between about 40° to 50°, at least one pair of slots in the second group of slots being angularly spaced from each other in a range between about 40° to 50°, wherein at least two radially adjacent slots of the first group of slots define a tine therebetween, and wherein the tine further includes at least one slot of the second group of slots disposed between the at least two radially adjacent slots of the first group, at least one pair of slots in the first group of slots having their innermost portions no further outward from the deflector axis than the peripheral surface of the apex, each slot of the second group of slots having their innermost portions further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

7. An early suppression fast response pendent-type fire protection sprinkler comprising:

a sprinkler body defining an orifice and an outlet for delivering a flow of fluid from a source, and having a minimum design flowing pressure of about 20 pounds per square inch;

at least one frame arm disposed in a plane having a first end extending from the body and a second end distal of the body; and means for providing ESFR protection to rack storage located beneath a ceiling having a maximum ceiling height up to about 35 feet, the rack storage being without any in rack sprinkler, solid shelves or open-top containers, the rack storage being any one of single-row, double-row and multiple-row rack, the rack storage including commodity having a maximum storage height ranging between about 25 feet and about 30 feet, the means including:

an apex joined to the second end of the at least one frame arm, the apex having a first end, a second end, and a peripheral surface extending between the first and second end of the apex; and a deflector coupled to the apex so that the second end of the at least one frame arm is located between the outlet of the body and the deflector, the deflector having a first surface opposed to the outlet and an outer peripheral edge, the deflector defining a first group and a second group of slots disposed about a deflector axis, at least one of the first and second group of slots having four pairs of opposed slots, each of the slots in each of the first and second group of slots extend from the first surface through the deflector and from slot openings at an outer peripheral edge of the deflector radially inward to an innermost portion of the slot, each slot of the first group of slots having a first width generally transverse to a first radial length extending perpendicular to the deflector axis, at least one pair of opposed pair of slots in the first group of slots each having a radial length between about 0.52 inches to about 0.62 inches, each slot of the second group of slots having a second width different than the first width and generally transverse to a second radial length extending perpendicular to the deflector axis that is different than the first radial length, at least one pair of opposed slots in the second group of slots each having their second radial length between about between 0.32 to about 0.42 inches, at least one pair of slots in the first group of slots being angularly spaced from each other in a range between about 40° to 50°, at least one pair of slots in the second group of slots being angularly spaced from each other in a range between about 40° to 50°, wherein at least two radially adjacent slots of the first group of slots define a tine therebetween, and wherein the tine further includes at least one slot of the second group of slots disposed between the at least two radially adjacent slots of the first group, at least one pair of slots of the first group of slots having their innermost portions no further outward from the deflector axis than the peripheral surface of the apex, each slot of the second group of slots having their innermost portions further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the axis.

8. An early suppression fast response pendent-type fire protection sprinkler comprising:

a sprinkler body defining an orifice and an outlet for delivering a flow of fluid from a source, and having a minimum design flowing pressure of about 25 pounds per square inch;

at least one frame arm disposed in a plane having a first end extending from the body and a second end distal of the body; and means for providing ESFR protection to rack storage located beneath a ceiling having a maximum ceiling height up to about 40 feet, the rack storage being without any in rack sprinkler, solid shelves or open-top containers, the rack storage being any one of single-row, double-row and multiple-row rack, the rack storage including commodity having a maximum storage height ranging between about 25 feet to about 35 feet, the means including:

an apex joined to the second end of the at least one frame arm, the apex having a first end, a second end, and a peripheral surface extending between the first and second end of the apex; and a deflector coupled to the apex so that the second end of the at least one frame arm is located between the outlet of the body and the deflector, the deflector having a first surface opposed to the outlet and an outer peripheral edge, the deflector defining a first group and a second group of slots disposed about a deflector axis, at least one of the first and second group of slots having four pairs of opposed slots, each of the slots in each of the first and second group of slots extend from the first surface through the deflector and from slot openings at an outer peripheral edge of the deflector radially inward to an innermost portion of the slot, each slot of the first group of slots having a first width generally transverse to a first radial length extending perpendicular to the deflector axis, at least one pair of opposed pair of slots in the first group of slots each having a radial length between about 0.52 inches to about 0.62 inches, each slot of the second group of slots having a second width different than the first width and generally transverse to a second radial length extending perpendicular to the deflector axis that is different than the first radial length, at least one pair of opposed slots in the second group of slots each having their second radial length between about between 0.32 to about 0.42 inches, at least one pair of slots in the first group of slots being angularly spaced from each other in a range between about 40° to 50°, at least one pair of slots in the second group of slots being angularly spaced from each other in a range between about 40° to 50°, wherein at least two radially adjacent slots of the first group of slots define a tine therebetween, and wherein the tine further includes at least one slot of the second group of slots disposed between the at least two radially adjacent slots of the first group, at least one pair of slots of the first group of slots having their innermost portions no further outward from the deflector axis than the peripheral surface of the apex, each slot of the second group of slots having their innermost portions further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

9. An early suppression fast response pendent-type fire protection sprinkler comprising:

a sprinkler body defining an orifice and an outlet for delivering a flow of fluid from a source, and having a minimum design flowing pressure of about 40 pounds per square inch;

at least one frame arm disposed in a plane having a first end extending from the body and a second end distal of the body; and means for providing ESFR protection to rack storage located beneath a ceiling having a maximum ceiling height up to about 45 feet, the rack storage being without any in rack sprinkler, solid shelves or open-top containers, the rack storage being any one of single-row, double-row and multiple-row rack, the rack storage including commodity having a maximum storage height ranging between about 25 feet to about 40 feet, the means including:

an apex joined to the second end of the at least one frame arm, the apex having a first end, a second end, and a peripheral surface extending between the first and second end of the apex; and a deflector coupled to the apex so that the second end of the at least one frame arm is located between the outlet of the body and the deflector, the deflector having a first surface opposed to the outlet and an outer peripheral edge, the deflector defining a first group and a second group of slots disposed about a deflector axis, at least one of the first and second group of slots having four pairs of opposed slots, each of the slots in each of the first and second group of slots extend from the first surface through the deflector and from slot openings at an outer peripheral edge of the deflector radially inward to an innermost portion of the slot, each slot of the first group of slots having a first width generally transverse to a first radial length extending perpendicular to the deflector axis, at least one pair of opposed pair of slots in the first group of slots each having a radial length between about 0.52 inches to about 0.62 inches, each slot of the second group of slots having a second width different than the first width and generally transverse to a second radial length extending perpendicular to the deflector axis that is different than the first radial length, at least one pair of opposed slots in the second group of slots each having their second radial length between about between 0.32 to about 0.42 inches, at least one pair of slots in the first group of slots being angularly spaced from each other in a range between about 40° to 50°, at least one pair of slots in the second group of slots being angularly spaced from each other in a range between about 40° to 50°, wherein at least two radially adjacent slots of the first group of slots define a tine therebetween, and wherein the tine further includes at least one slot of the second group of slots disposed between the at least two radially adjacent slots of the first group, at least one pair of slots of the first group of slots having their innermost portions no further outward from the deflector axis than the peripheral surface of the apex, each slot of the second group of slots having their innermost portions further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

10. An early suppression fast response fire protection sprinkler comprising:

a sprinkler body defining an orifice and an outlet for delivering a flow of fluid from a source, the body further defining a K-Factor of at least one of about 17, 19, 22, 25, 28 and 33;

at least one frame arm disposed in a plane having a first end extending from mount the body and a second end distal of the body; and means for providing ESFR protection to rack storage located beneath a ceiling having a maximum ceiling height up to about 30 feet, the rack storage being without solid shelves or open-top containers, the rack storage being any one of single-row, double-row and multiple-row rack, the rack storage including commodity having a maximum storage height of about 25 feet, the means including:

an apex joined to the second end of the at least one frame arm, the apex having a first end, a second end, and a peripheral surface extending between the first and second end of the apex; and a deflector coupled to the apex so that the second end of the at least one frame arm is located between the outlet of the body and the deflector, the deflector having a first surface opposed to the outlet and an outer peripheral edge, the deflector defining a first group of slots and a second group of slots disposed about a deflector axis, each of the first and second groups of slots having at least four pairs of opposed slots, each of the slots in each of the first and second groups of slots extending from the first surface through the deflector and from slot openings at an outer peripheral edge of the deflector radially inward to an innermost portion of the slot, each slot of the first group of slots having a first radial length extending perpendicular to the deflector axis, the first radial length ranging between about 0.52 inches to about 0.62 inches, each slot of the second group of slots having a second radial length extending perpendicular to the deflector axis that is different than the first radial length, the second radial length ranging between about between 0.32 to about 0.42 inches, the first group of slots having at least one pair of opposed slots defining a first width generally transverse to the first radial length of the at least one pair of slots in the first group, the second group of slots having at least one pair of opposed slots defining a second width generally transverse to the second radial length of the at least one pair of slots in the second group, the first group having at least three slots disposed to one side of the plane, the second group having at least four slots disposed to one side of the plane, wherein at least two radially adjacent slots of the first group of slots define a tine therebetween, wherein the tine further includes at least one slot of the second group of slots disposed between the at least two radially adjacent slots of the first group, at least one pair of slots of the first group of slots having their innermost portions no further outward from the deflector axis than the peripheral surface of the apex, each slot of the second group of slots having the innermost portion further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot lone by one foot wide pan centered at a three foot radius from the deflector axis.

11. An early suppression fast response fire protection sprinkler comprising:

a sprinkler body defining an orifice and an outlet for delivering a flow of fluid from a source, the body further defining a K-Factor of at least one of about 17, 19, 22, 25, 28 and 34;

at least one frame arm disposed in a plane having a first end mount to the body and a second end distal of the body; and means for providing ESFR protection to rack storage located beneath a ceiling having a maximum ceiling height up to about 35 feet, the rack storage being without solid shelves or open-top containers, the rack storage being any one of single-row, double-row and multiple-row rack, the rack storage including commodity having a maximum storage height ranging between about 25 feet to about 30 feet, the means including:

an apex joined to the second end of the at least one frame arm, the apex having a first end, a second end, and a peripheral surface extending between the first and second end of the apex; and a deflector coupled to the apex so that the second of the at least one frame arm is located between the outlet of the body and the deflector, the deflector having a first surface opposed to the outlet and an outer peripheral edge, the deflector defining a first group of slots and a second group of slots disposed about a deflector axis, each of the first and second groups of slots having at least four pairs of opposed slots, each of the slots in each of the first and second groups of slots extending from the first surface through the deflector and from slot openings at an outer peripheral edge of the deflector radially inward to an innermost portion of the slot, each slot of the first group of slots having a first radial length extending perpendicular to the deflector axis, the first radial length ranging between about 0.52 inches to about 0.62 inches, each slot of the second group of slots having a second radial length extending perpendicular to the deflector axis that is different than the first radial length, the second radial length ranging between about between 0.32 to about 0.42 inches, the first group of slots having at least one pair of opposed slots defining a first width generally transverse to the first radial length of the at least one pair of slots in the first group, the second group of slots having at least one pair of opposed slots defining a second width generally transverse to the second radial length of the at least one pair of slots in the second group, the first group having at least three slots disposed to one side of the plane, the second group having at least four slots disposed to one side of the plane, wherein at least two radially adjacent slots of the first group of slots define a tine therebetween, wherein the tine further includes at least one slot of the second group of slots disposed between the at least two radially adjacent slots of the first group, at least one pair of slots of the first group of slots having their innermost portions no further outward from the deflector axis than the peripheral surface of the apex, each slot of the second group of slots having their innermost portions further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

12. An early suppression fast response fire protection sprinkler comprising:

a sprinkler body defining an orifice and an outlet for delivering a flow of fluid from a source, the body further defining a K-Factor of at least one of about 17, 19, 22, 25, 28 and 34;

at least one frame arm disposed in a plane having a first end extending from the body and a second end distal of the body; and means for providing ESFR protection to rack storage located beneath a ceiling having a maximum ceiling height up to about 40 feet, the rack storage being without solid shelves or open-top containers, the rack storage being any one of single-row, double-row and multiple-row rack, the rack storage including commodity having a maximum storage height ranging from about 25 feet to about 35 feet, the means including:

an apex joined to the second end of the at least one frame arm, the apex having a first end, a second end, and a peripheral surface extending between the first and second end of the apex; and a deflector coupled to the apex so that the second end of the at least one frame arm is located between the outlet of the body and the deflector, the deflector having a first surface opposed to the outlet and an outer peripheral edge, the deflector defining a first group of slots and a second group of slots disposed about a deflector axis, each of the first and second groups of slots having at least four pairs of opposed slots, each of the slots in each of the first and second groups of slots extending from the first surface through the deflector and from slot openings at an outer peripheral edge of the deflector radially inward to an innermost portion of the slot, each slot of the first group of slots having a first radial length extending perpendicular to the deflector axis, the first radial length ranging between about 0.52 inches to about 0.62 inches, each slot of the second group of slots having a second radial length extending perpendicular to the deflector axis that is different than the first radial length, the second radial length ranging between about between 0.32 to about 0.42 inches, the first group of slots having at least one pair of opposed slots defining a first width generally transverse to the first radial length of the at least one pair of slots in the first group, the second group of slots having at least one pair of opposed slots defining a second width generally transverse to the second radial length of the at least one pair of slots in the second group, the first group having at least three slots disposed to one side of the plane, the second group having at least four slots disposed to one side of the plane, wherein at least two radially adjacent slots of the first group of slots define a tine therebetween, wherein the tine further includes at least one slot of the second group of slots disposed between the at least two radially adjacent slots of the first group, at least one pair of the first group of slots having their innermost portions no further outward from the deflector axis than the peripheral surface of the apex, each slot of the second group of slots having their innermost portions further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

13. An early suppression fast response fire protection sprinkler comprising:

a sprinkler body defining an orifice and an outlet for delivering a flow of fluid from a source, the body further defining a K-Factor of at least one of about 17, 19, 22, 25, 28 and 34;

at least one frame arm disposed in a plane having a first end extending from the body and a second end distal of the body; and means for providing ESFR protection to rack storage located beneath a ceiling having a maximum ceiling height up to about 45 feet, the rack storage being without solid shelves or open-top containers, the rack storage being any one of single-row, double-row and multiple-row rack, the rack storage including commodity having a maximum storage height ranging between about 25 feet to about 40 feet, the means including:

an apex joined to the second end of the at least one frame arm, the apex having a first end, a second end, and a peripheral surface extending between the first and second end of the apex; and a deflector coupled to the apex so that the second end of the at least one frame arm is located between the outlet of the body and the deflector, the deflector having a first surface opposed to the outlet and an outer peripheral edge, the deflector defining a first group of slots and a second group of slots disposed about a deflector axis, each of the first and second groups of slots having at least four pairs of opposed slots, each of the slots in each of the first and second groups of slots extending from the first surface through the deflector and from slot openings at an outer peripheral edge of the deflector radially inward to an innermost portion of the slot, each slot of the first group of slots having a first radial length extending perpendicular to the deflector axis, the first radial length ranging between about 0.52 inches to about 0.62 inches, each slot of the second group of slots having a second radial length extending perpendicular to the deflector axis that is different than the first radial length, the second radial length ranging between about between 0.32 to about 0.42 inches, the first group of slots having at least one pair of opposed slots defining a first width generally transverse to the first radial length of the at least one pair of slots in the first group, the second group of slots having at least one pair of opposed slots defining a second width generally transverse to the second radial length of the at least one pair of slots in the second group, the first group having at least three slots disposed to one side of the plane, the second group having at least four slots disposed to one side of the plane, wherein at least two radially adjacent slots of the first group of slots define a tine therebetween, wherein the tine further includes at least one slot of the second group of slots disposed between the at least two radially adjacent slots of the first group, at least one pair of slots of the first group of slots having their innermost portions no further outward from the deflector axis than the peripheral surface of the apex, each slot of the second group of slots having their innermost portions further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

14. The sprinkler of any one of claims 1, 2-5, and 6-13, wherein the outer peripheral edge defines a diameter of about 1.75 inches.

15. The sprinkler of any one of claims 1, 2-5, and 6-13, wherein the apex defines a curved profile in the direction of the deflector axis.

16. The sprinkler of claim 15, wherein the apex is substantially conical.

17. The sprinkler of any one of claims 1, 2-5, and 6-13, wherein the deflector includes at least one pair of slots starting radially internally of the peripheral edges and extending toward the deflector axis.

18. The sprinkler of any one of claims 1, 2-5, and 6-13, wherein the sprinkler has a hydraulic design with a hose stream allowance of about two hundred fifty gallons per minute (250 gpm) for a minimum water supply duration of one hour (1 hr.).

19. The sprinkler of any one of claims 1, 2-5, and 6-13, wherein the test, the average water density provided by the sprinkler is greater than about 1.00 gallons per minute per square foot into the one foot long by one foot wide pan.

20. The sprinkler of claim 19, wherein the test, the average water density provided by the sprinkler ranges from about 1.15 to about 1.3 gallons per minute per square foot into the one foot long by one foot wide pan.

21. The sprinkler of any one of claims 1, 2-5, and 6-13, wherein the sprinkler is adapted, upon impingement of the flow of fluid upon the deflector, to distribute the fluid over an area to be protected from a fire, the area being generally confined within a spray pattern of the sprinkler, the spray pattern comprising at least three portions defined radially from the longitudinal axis, a first of the three portions being most radially central, a second of the three portions being more radially distant, and a third of the three portions being most radially remote, all with respect to the central axis, said fluid being distributed by the sprinkler in a specific space quantity relationship in each of the three portions, wherein the first portion received the relatively greatest quantity per unit area of fluid within the spray pattern, the second portion receiving the greater quantity per unit area within the spray pattern than the third portion, and wherein the second portion is segregated into adjacent zones of different concentrations of fluid.

22. The sprinkler of any one of claims 1, 2-5, and 6-13, wherein the slots of one group of the at least two groupings of slots consists of slots of the same length.

23. The sprinkler of any one of claims 1, 2-5, and 6-13, wherein the slots of one group of the at least two groupings of slots consists of slots of different lengths.

24. The sprinkler of claim 23, wherein the slot length of at least one pair of slots in one grouping of slots is about 0.57 inches and the slot length of at least one pair of slots in another grouping of slots is about 0.32 inches.

25. The sprinkler of any one of claims 1, 2-5, and 6-13, wherein the first width ranges from about 0.08 to about 0.17 and the second width ranges from about 0.08 to about 0.20 inches.

26. The sprinkler of claim 25, wherein the first width ranges from about 0.13 to about 0.17 and the second width ranges from about 0.08 to about 0.10 inches.

27. The sprinkler of claim 26, wherein the first width is about 0.13 and the second width is about 0.10 inches.

28. The sprinkler of any one of claims 1 and 2-5, wherein at least one pair of slots in at least one of the groupings of slots has an angular spacing therebetween ranging between about 40° to 50°.

29. The sprinkler of claim 28, wherein the at least one pair of slots are angularly spaced about the peripheral edge at about 45°.

30. The sprinkler of any one of claims 1, 2-5, and 6-13, wherein disposed to one side of the plane are an odd number of slots.

31. The sprinkler of any one of claims 1, 2-5, and 6-13, wherein the deflector includes a third group of slots having at least one of a third radial length different than the first and second lengths and a third width different than the first and second widths, wherein further an odd number of slots being disposed to one side of the plane.

32. The sprinkler of claim 31, wherein the odd number is seven.

33. The sprinkler of claim 31, wherein the odd number is nine.

34. The sprinkler of any one of claims 1, 2-5, and 6-13, wherein at least one of the slots is a reentrant slot.

35. The sprinkler of any one of claims 1, 2-5, and 6-13, wherein the at least two grouping of slots includes a third group of slots having at least one of a third width generally transverse to a third slot length extending perpendicular to the deflector axis, wherein the third width is different than the first or second widths or the third slot length is different from the first or second slot lengths, wherein further the third group of slots include at least one pair of opposed slots disposed in the plane.

36. The sprinkler of any one of claims 1, 2-5, and 6-13, further defining a maximum deflector-to-ceiling distance for the pendent sprinkler ranging between 14 inches to about 18 inches.

37. The sprinkler of claim 36, wherein the sprinkler is suited for installation with the deflector disposed about 18 inches below a ceiling.

38. The sprinkler of any one of claims 1, 2-5, and 6-13, wherein the deflector has a thickness measured from the first surface in the direction of fluid flow equal to or greater than about 0.06 inch.

39. The sprinkler of claim 38, wherein the thickness of the deflector ranges from about 0.06 inches to about 0.09 inches.

40. The sprinkler of any one of claims 1 and 2-5, wherein the thermally responsive element includes a strut member and a lever member.

41. The sprinkler of claim 40, wherein the thermally responsive element further comprises a fastener engaged with the element to support the strut member.

42. The sprinkler of any one of claims 1 and 2-5, wherein the thermally responsive element comprises a fusible solder alloy.

43. The sprinkler of claim 42, wherein the thermally responsive element has a temperature rating between 165° F. (74° C.) and 214° F. (101° C.).

44. The sprinkler of claim 41, wherein the thermally responsive element further comprises a threaded fastener engaged with the element to coaxially support the lever.

45. The sprinkler of any one of claims 1 and 2-5, wherein the K-factor of the body is 25.2.

46. The sprinkler of any one of claims 1, 2-5, and 6-13, wherein the at least one of a single row rack storage, double row rack storage and multiple row rack storage further includes portable storage.

47. The sprinkler of any one of claims 1, 2-5, and 6-13, wherein the at least one of a single row rack storage, double row rack storage and multiple row rack storage further includes encapsulated or non-encapsulated materials.

48. The sprinkler of any one of claims 1, 2-5, and 6-13, wherein the at least one of a single row rack storage, double row rack storage and multiple row rack storage further includes at least one of Class I, Class II, Class III and Class IV commodities.

49. The sprinkler of any one of claims 1, 2-5, and 6-13, wherein the at least one of a single row rack storage, double row rack storage and multiple row rack storage further includes at least one of roll paper and rubber tires.

50. An early suppression fast response pendent-type fire protection sprinkler comprising:

a sprinkler body defining an orifice and an outlet along a longitudinal axis that delivers a flow of fluid from a source, the sprinkler body having a K-factor of about 25 and a base having a pair of arms disposed on a plane and diametrically mounted about the base;

a plug axially aligned and adjacent the outlet of the body;

a thermally responsive element supporting the plug to close the outlet;

an apex disposed along the longitudinal axis, each of the arms having one end joined at the body and another end joined to the apex, the apex further having a first end and a second end, the second end being wider than the first end, the apex having an outer peripheral surface extending between the first and second end defining a curved surface in the direction of the longitudinal axis;

a deflector having a central deflector axis, the deflector being affixed to the apex so as to locate the apex between the outlet and the deflector with the affixed apex being centrally disposed along the deflector axis and the second end of the apex adjacent the deflector, the deflector including a first surface opposed to the outlet, the deflector defining at least two grouping of slots disposed about the deflector axis, each of the at least two grouping of slots having at least two slots, each of the slots in each of the at least two grouping of slots extending from the first surface through the deflector and from slot openings at an outer peripheral edge of the deflector inward to an innermost portion of the slot so as to define a slot length extending along a slot centerline, the slot length of the slots in one grouping varying from the slot lengths of the slots in another grouping of the at least two grouping of slots, each slot of one grouping of the at least two groupings of slots having a first width generally transverse the slot centerline of the slot of the one group, each slot of another grouping of the at least two groupings of slots having a second width different than the first width and generally transverse to the slot centerline of the slot of the other group, at least one of the at least two grouping of slots having at least four slots disposed to one side of the plane, the other of the at least two grouping of slots having at least three radial slots disposed to one side of the plane, wherein the first surface being configured to deflect the flow of fluid to suppress a fire in at least one of a single row rack storage, double row rack storage, multiple row rack storage and portable row rack storage having a maximum storage height in a storage area having a maximum ceiling height, with no open containers and no solid shelves, the body having a minimum design flowing pressure measured in pounds per square inch for the given maximum storage height and the maximum ceiling height, wherein when the maximum storage height is about 35 feet and the maximum ceiling height is about 40 feet, the minimum design flowing pressure being 25 pounds per square inch, or wherein when the maximum storage height is about 40 feet and the maximum ceiling height is about 45 feet, the minimum design flowing pressure being 40 pounds per square inch, and wherein further, at least two slots of one grouping of the at least two grouping of slots has the innermost portion no further outward from the deflector axis than the peripheral surface of the apex, each slot of the other grouping of slots has the innermost portion further outward from the deflector axis than the peripheral surface of the apex, the at least two grouping of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the longitudinal axis.

51. A pendent-type of early suppression fast response (ESFR) sprinkler, comprising:

a sprinkler body having an inlet and an outlet to define an axis to deliver a flow of fluid from a source;

a pair of frame arms having a first end extending from the body and a second end distal of the body;

an apex joined to the second end of each of the arms, the apex having a first end and a second end, the second end being wider than the first end, the apex having an outer peripheral surface extending between the first and second end;

a plug that closes the outlet of the sprinkler body;

a thermally responsive element that supports the apex in the outlet; and means for providing ESFR protection to rack storage located beneath a ceiling having a maximum ceiling height up to about 45 feet, the rack storage being without any in rack sprinkler, solid shelves or open-top containers, the rack storage being any one of single-row, double-row and multiple-row rack, the rack storage including commodity having a maximum storage height ranging between about 25 feet to about 40 feet, the means defining a minimum design pressure for the pendent ESFR sprinkler ranging from about 15 psi, to about 40 psi, the means including:

a deflector having a central deflector axis, the deflector being coupled to the apex so that the second end of each of the arms is disposed between the deflector and the outlet of the body with the apex being centrally disposed along the deflector axis and the second end of the apex adjacent the deflector, the deflector having an outer peripheral edge and a first surface opposed to the outlet to deflect a flow of fluid from the outlet of the sprinkler body, the deflector defining a first group and a second group of slots disposed about the deflector axis, at least one of the first and second group of slots having four pairs of opposed slots, each of the slots in each of the first and second group of slots extend from the first surface through the deflector and from slot openings at the outer peripheral edge of the deflector radially inward to an innermost portion of the slot so as to define a slot length extending along a slot centerline, each slot of the first group of slots having a first width generally transverse to the slot centerline, the slot length in at least one pair of opposed pair of slots in the first group of slots ranging between about 0.52 inches to about 0.62 inches, each slot of the second group of slots having a second width generally transverse to the slot centerline different than the first width the slot length in at least one pair of opposed slots in the second group of slots ranging between about between 0.32 to about 0.42 inches, at least two of the slots in the first group of slots being angularly spaced from each other between about 40° to 50°, and at least two of the slots in the second group of slots being angularly spaced from each other between about 40° to 50°, at least one pair of slots of the first group of slots having the innermost portion no further outward from the deflector axis than the peripheral surface of the apex, each slot of the second group of slots having the innermost portion further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the axis of the sprinkler body.

52. A pendent-type early suppression fast response (ESFR) fire protection sprinkler, comprising:

a sprinkler body having an inlet and an outlet to define an axis to deliver a flow of fluid from a source and further defining a K-factor at least one of about 17 and 19;

a pair of frame arms disposed in a plane, the frame arms having a first end extending from the body and a second end distal of the body;

an apex joined to the second end of each of the arms, the apex having a first end and a second end, the second end being wider than the first end, the apex having an outer peripheral surface extending between the first and second end;

a plug that closes the outlet of the body;

a thermally responsive element that supports the plug in the outlet; and means for providing ESFR protection to rack storage located beneath a ceiling having a maximum ceiling height up to about 45 feet, the rack storage being without solid shelves or open-top containers, the rack storage being any one of single-row, double-row and multiple-row rack, the rack storage including commodity having a maximum storage height ranging between about 25 feet to about 40 feet, the means including:

a deflector having a central deflector axis, the deflector being coupled to the apex so that the second end of each of the arms is disposed between the deflector and the outlet of the body with the apex being centrally disposed along the deflector axis and the second end of the element adjacent the deflector, the deflector having an outer peripheral edge and a first surface opposed to the outlet, the deflector defining a first group of slots and a second group of slots disposed about the deflector axis, each of the first and second groups of slots having at least four pairs of opposed slot, each of the slots in each of the first and second groups of slots extending from the first surface through the deflector from slot openings at the outer peripheral edge extending radially inward to an innermost portion of the slot so as to define a slot length extending along a slot centerline, the slot length of each slot of the first group of slots ranging between about 0.52 inches to about 0.62 inches, the slot length of each slot of the second group of slots ranging between about between 0.32 to about 0.42 inches, wherein at least two radially adjacent slots of the first group of slots define a tine therebetween, wherein the tine further includes at least one slot of the second group of slots disposed between the at least two radially adjacent slots of the first group, at least one pair of slots of the first group of slots having the innermost portion no further outward from the deflector axis than the peripheral surface of the apex, each slot of the second group of slots having the innermost portion further outward from the deflector axis than the peripheral surface of the apex, the first and second group of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the axis of the sprinkler body.

53. A pendent early suppression fast response (ESFR) sprinkler, comprising:

a sprinkler body having an inlet and an outlet to define an axis to deliver a flow of fluid from a source and further defining a K-factor of about 25;

at least one frame arm disposed in a plane;

an apex joined to the second end of the at least one frame arm, the apex having a first end and a second end, the second end of the apex being wider than the first end of the element, the element having an outer peripheral surface extending between the first and second end; and means for providing ESFR protection to rack storage located beneath a ceiling having a maximum ceiling height up to about 45 feet, the rack storage being without any in rack sprinkler, solid shelves or open-top containers, the rack storage being any one of single-row, double-row and multiple-row rack, the rack storage including commodity having a maximum storage height ranging between about 25 feet to about 40 feet, the means defining a minimum design pressure for the pendent ESFR sprinkler ranging from about 15 psi, to about 40 psi, the means further including:

a deflector having a central deflector axis, the deflector being coupled to the apex so that the apex is centrally disposed along the deflector axis and the second end of the apex is adjacent the deflector, the deflector having an outer peripheral edge and a first surface opposed to the outlet to deflect a flow of fluid from the outlet of the sprinkler body, the deflector defining a first group and a second group of slots disposed about the deflector axis, at least one of the first and second group of slots having four pairs of opposed slots about the plane, each of the slots in each of the first and second group of slots extend from the first surface through the deflector and from slot openings at an outer peripheral edge of the deflector radially inward to an innermost portion of the slot so as to define a slot length extending along a slot centerline, the slot lengths of the first group being different than the slot lengths of the second group, the innermost portion of at least one of the first and second groups of slots being no more radially inward than the peripheral surface of the apex, each slot of the first group of slots having a first width generally transverse to the slot centerline of the slot, the slot lengths of at least one pair of the four opposed pair of slots in the first group of slots ranging between about 0.52 inches to about 0.62 inches, each slot of the second group of slots having a second width generally transverse to the slot centerline of the slot different than the first width, the slot lengths of at least one pair of opposed slots in the second group of slots ranging between about between 0.32 to about 0.42 inches, at least one pair of the slots in the first group of slots being angularly spaced from each other ranging between about 40° to 50°, at least one pair of the slots in the second group of slots being angularly spaced from each other ranging between about 40° to 50°, at least one pair of slots of the first group of slots having the innermost portion no further outward from the deflector axis than the peripheral surface of the apex, each slot of the other group of slots having the innermost portion further outward from the deflector axis than the peripheral surface of the apex, the first and second group of slots being disposed so that the fluid flow is distributed in a pattern such that the pendent ESFR sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the axis of the sprinkler body.

54. A pendent early suppression fast response (ESFR) sprinkler, comprising:

a sprinkler body having an inlet and an outlet to define an axis to deliver a flow of fluid from a source and further defining a K-factor of about 17;

at least one frame arm disposed in a plane;

an apex joined to the second end of the at least one frame arm, the apex having a first end and a second end, the second end of the apex being wider than the first end, the apex having an outer peripheral surface extending between the first and second end; and means for providing ESFR protection to rack storage located beneath a ceiling having a maximum ceiling height up to about 45 feet, the rack storage being without solid shelves or open-top containers, the rack storage being any one of single-row, double-row and multiple-row rack, the rack storage including commodity having a maximum storage height ranging between about 25 feet to about 40 feet, the means further including:

a deflector having a central deflector axis, the deflector being coupled to the apex so that the apex is centrally disposed along the deflector axis and the second end of the apex is adjacent the deflector, having a first surface opposed to the outlet to deflect a flow of fluid from the outlet of the sprinkler body, the deflector including an outer peripheral edge, the deflector defining a first group of slots and a second group of slots disposed about the deflector axis, at least one of the first and second groups of slots having at least four pairs of opposed slot disposed about the plane, each of the slots in each of the first and second groups of slots extending from the first surface through the deflector and from slot openings at an outer peripheral edge of the deflector radially inward to an innermost portion of the slot so as to define a slot length extending along a slot centerline, the slot lengths of each slot of the first group of slots ranging between about 0.52 inches to about 0.62 inches, the slot lengths of each slot of the second group of slots ranging between about 0.32 to about 0.42 inches, the first group of slots having at least one pair of opposed slots defining a first width generally transverse to the slot centerline of the at least one pair of the first group, the second group of slots having at least one pair of opposed slots defining a second width different than the first width and generally transverse to the slot centerline of the at least one pair of the second group, at least one pair of slots of the first group of slots having the innermost portion no further outward from the deflector axis than the peripheral surface of the apex, each slot of the second group of slots having their innermost portion further outward from the deflector axis than the peripheral surface of the apex, the first and second group of slots being disposed so that the fluid flow is distributed in a pattern such that the pendent ESFR sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the axis of the sprinkler body.

55. An early suppression fast response pendent-type fire protection sprinkler comprising:

a sprinkler body defining an orifice and an outlet that delivers a flow of fluid from a source, the sprinkler body having a K-factor of about 25 and a minimum design flowing pressure of 15 pounds per square inch;

an apex having a first end and a second end, the second end of the apex being wider than the first end, the apex having an outer peripheral surface extending between the first and second end; and a deflector having a central deflector axis, the deflector being mounted to the apex so that the apex is centrally disposed along the deflector axis and the second end of the apex is adjacent the deflector, the deflector being mounted with a first surface opposed to the flow of fluid from the outlet to deflect the flow of fluid to suppress a fire in at least one of a single row rack storage, double row rack storage and multiple row rack storage having a maximum storage height of 25 feet in a storage area having a maximum ceiling height of 30 feet, with no open containers and no solid shelves, the first surface defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector radially inward to an innermost portion of the slot so as to define a slot length extending along a slot centerline, the slot length of each grouping of slots being different than the slot length of another grouping of the at least two grouping of slots, each slot of one grouping of slots having a first width generally transverse to the slot centerline of the slot in the one grouping, each slot of another grouping of slots having a second width different than the first width and generally transverse to the slot centerline of the slot in the other grouping of slots, at least one pair of slots of one of the at least two grouping of slots having the innermost portion no further outward from the deflector axis than the peripheral surface of the apex, each slot of the other of the at least two grouping of slots having the innermost portion further outward from the deflector axis than the peripheral surface of the apex, the at least two grouping of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

56. An early suppression fast response pendent-type fire protection sprinkler comprising:

a sprinkler body defining an orifice and an outlet that delivers a flow of fluid from a source, the sprinkler body having a K-factor of about 25 and a minimum design flowing pressure of 20 pounds per square inch at a most hydraulically remote sprinkler;

an apex having a first end and a second end, the second end of the apex being wider than the first end, the apex having an outer peripheral surface extending between the first and second end; and a deflector having a central deflector axis, the deflector being coupled to the apex so that the apex is centrally disposed along the deflector axis and the second end of the apex is adjacent the deflector, including a first surface opposed to the flow of fluid from the outlet to deflect the flow of fluid to suppress a fire in at least one of a single row rack storage, double row rack storage and multiple row rack storage having a maximum storage height of 30 feet in a storage area having a maximum ceiling height of 35 feet, with no open containers and no solid shelves, the first surface defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector radially inward to an innermost portion of the slot so as to define a slot length extending along a slot centerline, the slot length of one grouping of slots being different than the slot length of another grouping of the at least two grouping of slots, each slot of one grouping of the at least two groupings of slots having a first width generally transverse to the slot centerline of the slot in the one grouping, each slot of another grouping of the at least two groupings of slots having a second width different than the first width and generally transverse to the slot centerline, at least one pair of slots of one of the at least two grouping of slots having the innermost portion no further outward from the deflector axis than the peripheral surface of the apex, each slot of the other of the at least two grouping of slots having the innermost portion further outward from the deflector axis than the peripheral surface of the apex, the at least two grouping of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

57. An early suppression fast response pendent-type fire protection sprinkler comprising:

a sprinkler body defining an orifice and an outlet that delivers a flow of fluid from a source, the sprinkler body having a K-factor of about 25 and a minimum design flowing pressure of 25 pounds per square inch;

an apex having a first end and a second end, the second end of the apex being wider than the first end, the apex having an outer peripheral surface extending between the first and second end; and a deflector having a central deflector axis, the deflector being coupled to the apex so that the apex is centrally disposed along the deflector axis and the second end of the apex is adjacent the deflector, the deflector including a first surface opposed to the flow of fluid from the outlet to deflect the flow of fluid to suppress a fire in at least one of a single row rack storage, double row rack storage and multiple row rack storage having a maximum storage height of 35 feet in a storage area having a maximum ceiling height of 40 feet, with no open containers and no solid shelves, the first surface defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector radially inward to an innermost portion of the slot so as to define a slot length extending along a slot centerline, the slot length of one grouping of slots being different than the slot length of another grouping of the at least two grouping of slots, each slot of one grouping of the at least two groupings of slots having a first width generally transverse to the slot centerline, each slot of another grouping of the at least two groupings of slots having a second width different than the first width and generally transverse to the slot centerline, each slot of one of the at least two grouping of slots having the innermost portion no further outward from the deflector axis than the peripheral surface of the apex, at least one pair of slots of the other of the at least two grouping of slots having the innermost portion further outward from the deflector axis than the peripheral surface of the apex, the at least two grouping of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

58. An early suppression fast response pendent-type fire protection sprinkler comprising:

a sprinkler body defining an orifice and an outlet along a longitudinal axis that delivers a flow of fluid from a source, and a base having a pair of arms diametrically mounted about the base, the orifice and outlet defining a K-factor of any one of about 17, 19, 22, 25, 28, and 34;

a plug axially aligned and adjacent the outlet, and a thermally responsive element supporting the plug to close the outlet;

an apex disposed along the longitudinal axis, the arms being joined at the apex, the apex having a first end and a second end, the second end of the apex being wider than the first end, the apex having an outer peripheral surface extending between the first and second end defining a curve in the direction of the longitudinal axis;

a deflector having a central deflector axis being affixed to the apex so that the apex is centrally disposed along the deflector axis and the second end of the apex is adjacent the deflector, the deflector including a first surface opposed to the flow of fluid from the outlet, the deflector defining at least two grouping of slots disposed about the deflector axis, each of the at least two grouping of slots having at least two slots, each of the slots in each of the at least two grouping of slots extending from the first surface through the deflector, and from slot openings at an outer peripheral edge of the deflector radially inward to an innermost portion of the slot so as to define a slot length extending along a slot centerline, the slot length of one grouping of slots defining a maximum first slot length the slot length of another grouping of the at least two grouping of slots defining a maximum second slot length different than the maximum first slot length, each slot of one grouping of the at least two groupings of slots having a first width generally transverse to the slot centerline of the slot in the one grouping, each slot of another grouping of the at least two groupings of slots having a second width different than the first width and generally transverse to the slot centerline of the slot of the other grouping, at least one pair of slots of one of the at least two grouping of slots having the innermost portion no further outward from the deflector axis than the peripheral surface of the apex, each slot of the other of the at least two grouping of slots having the innermost portion further outward from the deflector axis than the peripheral surface of the apex, the at least two grouping of slots being disposed so that the fluid flow is distributed in a pattern such that the sprinkler provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the longitudinal axis, wherein the first surface being configured to deflect the flow of fluid to suppress a fire in at least one of a single row rack storage, double row rack storage, multiple row rack storage and portable row rack storage having a maximum storage height in a storage area having a maximum ceiling height, with no open containers and no solid shelves, the body having a minimum design flowing pressure measured in pounds per square inch at a most hydraulically remote sprinkler for the given maximum storage height and the maximum ceiling height, wherein when the maximum storage height is about 35 feet and the maximum ceiling height is about 40 feet, the minimum design flowing pressure being 25 pounds per square inch, or wherein when the maximum storage height is about 40 feet and the maximum ceiling height is about 45 feet, the minimum design flowing pressure being 40 pounds per square inch.

59. An early suppression fast response pendent-type fire protection sprinkler comprising:

a sprinkler body defining an orifice and an outlet that delivers a flow of fluid from a source, the sprinkler body having a K-factor of about 22 and a minimum design flowing pressure ranging from about 40 pounds per square inch to about 50 pounds per square inch;

an apex having a first end and a second end, the second end of the apex being wider than the first end, the apex having an outer peripheral surface extending between the first and second end;

a thermally responsive assembly, having a first end supported by the apex and a second end to maintain the outlet of the sprinkler body closed, the thermally responsive assembly including a strut, a lever and element secured together by a fusible solder alloy; and a deflector having a central deflector axis, being mounted adjacent the apex with a first inside surface and a second opposite surface, the first and second surfaces extending perpendicular to the deflector axis, the first surface being opposed to the flow of fluid from the outlet to deflect the flow of fluid to suppress a fire in at least one of a single row rack storage, double row rack storage and multiple row rack storage in a storage area having a maximum ceiling height of 30 feet, the deflector defining a plurality of slots disposed about the deflector axis, at least one of the plurality of slots extending from the first surface through the deflector, and from a slot opening at an outer peripheral edge of the deflector inwardly along a slot centerline to an innermost portion to define a slot length, at least a portion of the at least one slot having a first width and a second width each width being generally transverse to the slot centerline of the at least one slot, the first width being different than the second width such that the at least one slot tapers in a direction along the slot centerline between the peripheral edge of the deflector and the peripheral surface of the apex.

60. An early suppression fast response pendent-type fire protection sprinkler comprising:

a sprinkler body defining an orifice and an outlet that delivers a flow of fluid from a source, the sprinkler body having a K-factor of about 22 and a minimum design flowing pressure ranging from about 30 pounds per square inch to about 40 pounds per square inch;

an apex having a first end and a second end, the second end of the apex being wider than the first end, the apex having an outer peripheral surface extending between the first and second end;

a thermally responsive assembly having a first end supported by the apex and a second end to maintain the outlet of the sprinkler body closed, the thermally responsive assembly including a strut, a lever and element secured together by a fusible solder alloy; and a deflector having a central deflector axis, being mounted adjacent the apex with a first inside surface and a second opposite surface, the first and second surfaces extending perpendicular to the deflector axis, the first surface being opposed to the flow of fluid from the outlet to deflect the flow of fluid to suppress a fire in at least one of a single row rack storage, double row rack storage and multiple row rack storage in a storage area having a maximum ceiling height of 35 feet, the deflector defining a plurality of slots disposed about the deflector axis, at least one of the plurality of slots extending from the first surface through the deflector, and from a slot opening at an outer peripheral edge of the deflector inwardly along a slot centerline to an innermost portion to define a slot length, at least a portion of the at least one slot having a first width and a second width each width being generally transverse to the slot centerline of the at least one slot, the first width being different than the second width such a portion of that the at least one slot tapers in a direction along the slot centerline between the peripheral edge of the deflector and the peripheral surface of the apex.

61. An early suppression fast response pendent-type fire protection sprinkler comprising:

a sprinkler body defining an orifice and an outlet that delivers a flow of fluid from a source, the sprinkler body having a K-factor of about 22 and a minimum design flowing pressure ranging from about 40 pounds per square inch to about 50 pounds per square inch;

an apex having a first end and a second end, the second end of the apex being wider than the first end, the apex having an outer peripheral surface extending between the first and second end;

a thermally responsive assembly having a first end supported by the apex and a second end to maintain the outlet of the sprinkler body closed, the thermally responsive assembly including a strut, a lever and element secured together by a fusible solder alloy; and a deflector having a central deflector axis, being mounted adjacent the apex with a first inside surface and a second opposite surface, the first and second surfaces extending perpendicular to the deflector axis, the first surface being opposed to the flow of fluid from the outlet to deflect the flow of fluid to suppress a fire in at least one of a single row rack storage, double row rack storage and multiple row rack storage in a storage area having a maximum ceiling height of 40 feet, the deflector defining a plurality of slots disposed about the deflector axis, at least one of the plurality of slots extending from the first surface through the deflector, and from a slot opening at an outer peripheral edge of the deflector inwardly along a slot centerline to an innermost portion to define a slot length, at least a portion of the at least one slot having a first width and a second width each width being generally transverse to the slot centerline of the at least one slot, the first width being different than the second width such that the portion of at least one slot tapers in a direction along the slot centerline between the peripheral edge of the deflector and the peripheral surface of the apex.

62. An early suppression fast response pendent-type fire protection sprinkler comprising:

a sprinkler body defining an orifice and an outlet that delivers a flow of fluid from a source, the sprinkler body having a K-factor of about 22 and a minimum design flowing pressure ranging from about 20 pounds per square inch to about 30 pounds per square inch;

an apex having a first end and a second end, the second end of the apex being wider than the first end, the apex having an outer peripheral surface extending between the first and second end;

a thermally responsive assembly having a first end supported by the apex and a second end to maintain the outlet of the sprinkler body closed, the thermally responsive assembly including a strut, a lever and element secured together by a fusible solder alloy; and a deflector having a central deflector axis, being mounted adjacent the apex with a first inside surface and a second opposite surface, the first and second surfaces extending perpendicular to the deflector axis, the first surface being opposed to the flow of fluid from the outlet to deflect the flow of fluid to suppress a fire in at least one of a single row rack storage, double row rack storage and multiple row rack storage in a storage area having a maximum ceiling height of 30 feet, the deflector defining a plurality of slots disposed about the deflector axis, at least one of the plurality of slots extending from the first surface through the deflector, and from a slot opening at an outer peripheral edge of the deflector inwardly along a slot centerline to an innermost portion to define a slot length extending no more radial inward than the peripheral surface of the apex, at least a portion of the at least one slot having a first width and a second width each width being generally transverse to the slot centerline of the at least one slot, the first width being different than the second width such that the at least one slot tapers in a direction along the slot centerline between the peripheral edge of the deflector and the peripheral surface of the apex.

63. An early suppression fast response pendent-type fire protection sprinkler comprising:

a sprinkler body defining an orifice and an outlet along a longitudinal axis that delivers a flow of fluid from a source, the sprinkler body having a K-factor of about 22 and a base having a pair of arms diametrically mounted about the base;

a plug axially aligned and adjacent the outlet, and a thermally responsive element supporting the plug to close the outlet;

an apex disposed along the longitudinal axis having a first end and a second end, the second end of the apex being wider than the first end, the element having an outer peripheral surface extending between the first and second end;

a thermally responsive assembly having a first end supported by the apex and a second end to maintain the outlet of the sprinkler body closed, the thermally responsive assembly including a strut, a lever and two pieces of metal secured together by a fusible solder alloy; and a deflector having a central deflector axis, the deflector mounted adjacent the apex with a first inside surface and a second opposite surface, the first and second surfaces extending perpendicular to the deflector axis, the first surface being opposed to the flow of fluid from the outlet to deflect the flow of fluid to suppress a fire in at least one of a single row rack storage, double row rack storage and multiple row rack storage in a storage area, the deflector defining a plurality of slots disposed about the deflector axis, at least one of the plurality of slots extending from the first surface through the deflector, and from a slot opening at an outer peripheral edge of the deflector inwardly along a slot centerline to an innermost portion to define a slot length, at least a portion of the at least one slot having a first width and a second width each width being generally transverse to the slot centerline of the at least one slot, the first width being different than the second width such that the portion of the at least one slot tapers in a direction along the slot centerline between the peripheral edge of the deflector and the peripheral surface of the apex, wherein when the storage area has a maximum ceiling height is about 40 feet, a minimum design flowing pressure for the sprinkler ranges between about forty pounds per square inch and about fifty pounds per square inch, wherein when the storage area has a maximum ceiling height is about 45 feet, a minimum design flowing pressure for the sprinkler ranges between about forty pounds per square inch and about fifty pounds per square inch.

64. A pendent early suppression fast response (ESFR) sprinkler comprising:

a sprinkler body having an inlet and an outlet to define an axis to deliver a flow of fluid from a source and further defining a K-factor of about 17;

at least one frame arm;

an apex having a first end and a second end, the second end of the apex being wider than the first end, the apex having an outer peripheral surface extending between the first and second end; and means for providing ESFR protection to rack storage located beneath a ceiling having a maximum ceiling height up to about 45 feet, the rack storage being without solid shelves or open-top containers, the rack storage being any one of single-row, double-row and multiple-row rack, the rack storage including commodity having a maximum storage height ranging between about 25 feet to about 40 feet, the means further including:

a deflector having a central deflector axis, being mounted adjacent the apex having a first surface opposed to the outlet to deflect a flow of fluid from the outlet of the sprinkler body, the deflector including an outer peripheral edge that defines a diameter of about 1.75 inches, the deflector defining a first group of slots and a second group of slots disposed about the deflector axis, each of the first and second groups of slots having at least four pairs of opposed slots, each of the slots in each of the first and second groups of slots extending from the first surface through the deflector and from slot openings at an outer peripheral edge of the deflector radially inward along a slot centerline to an innermost portion, each slot of the first group of slots having a first slot length extending along the slot centerline, the first slot length ranging between about 0.52 inches to about 0.62 inches, each slot of the second group of slots having a second slot length extending along the slot centerline that is different than the first slot length, at least one pair of slots of one of the first and second group of slots having the innermost portion no further outward from the deflector axis than the peripheral surface of the apex, each slot of the other group of slots having the innermost portion further outward from the deflector axis than the peripheral surface of the apex, the first and second group of slots being disposed so that the fluid flow is distributed in a pattern such that the sprinkler-provides in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the axis of the sprinkler body.

65. An early suppression fast response (ESFR) fire protection sprinkler system, the sprinkler system comprising:

at least one pendent-type ESFR sprinkler installed beneath a ceiling having a maximum height of about 45 feet, the sprinkler providing in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from a sprinkler axis, the at least one ESFR sprinkler including:

a sprinkler body having an inlet and an outlet to define an axis to deliver a flow of fluid from a source and further defining a K-factor ranging between 14 and 30;

an apex having a first end and a second end, the second end of the apex being wider than the first end, the apex having an outer peripheral surface extending between the first and second end; and a deflector having a central deflector axis, the deflector being mounted to the apex so that the apex is centrally disposed along the deflector axis and the second end of the apex is adjacent the deflector, the deflector including a first surface opposed to the outlet to deflect a flow of fluid from the outlet of the sprinkler body, the deflector including an arcuate outer peripheral edge, a central portion substantially aligned along the axis, a thickness and a plurality of slots, each slot including a first edge and a second edge defining a slot centerline therebetween extending radially inward, the first edge and second edge extending from the outer peripheral edge toward the central portion to define a first slot end contiguous with the outer peripheral edge and a second slot end contiguous with the first and second edges to define an innermost portion of the slot, the second slot end and the first slot end being spaced apart along the slot centerline to define a slot length, the deflector including at least one pair of radially adjacent slots having the same slot length to define a tine therebetween, wherein the tine further defines a slot centrally disposed between the at least one pair of adjacent slots, the centrally disposed slot having a slot length smaller than the slot lengths of the at least one pair of adjacent slots, each slot of the at least one pair of adjacent slots having the innermost portion no further outward from the deflector axis than the peripheral surface of the apex, each of the centrally disposed slots having the innermost portion further outward from the deflector axis than the peripheral surface of the apex; the system further including rack storage located beneath the at least one pendent-type ESFR sprinkler, the rack storage being without solid shelves of a commodity without solid shelves and no open-top containers, the rack storage being any one of single-row, double-row and multiple-row rack, the commodity being at least one of encapsulated Class I, II, III or IV, or unencapsulated Class I, II, III or IV and having a maximum commodity height ranging between about 20 feet and about 40 feet, wherein the rack storage is without any in-rack sprinklers.

66. A pendent early suppression fast response (ESFR) sprinkler, comprising:

a sprinkler body having an inlet and an outlet to define an axis to deliver a flow of fluid from a source and further defining a K-factor of any one of about 17, 19, 22, 25, 28, and 34;

a pair of frame arms disposed in a plane, the frame arms having a first end extending from the body and a second end distal of the body;

an apex joined to the second end of each of the pair of arms, the apex having a first end and a second end, the second end of the apex being wider than the first end, the apex having an outer peripheral surface extending between the first and second end;

a plug that closes the outlet;

a thermally responsive element that supports the plug; and means for providing ESFR protection to rack storage located beneath a ceiling having a maximum ceiling height up to about 45 feet, the rack storage being without solid shelves or open-top containers, the rack storage being any one of single-row, double-row and multiple-row rack, the rack storage including commodity having a maximum storage height ranging between about 25 feet to about 40 feet, the means further including:

a deflector having a central deflector axis, the deflector being mounted to the apex so that the apex is centrally disposed along the deflector axis and the second end of the apex is adjacent the deflector, the deflector coupled to the apex so that the second end of each of the arms is disposed between the deflector and the outlet of the body, the deflector having an outer peripheral edge and a first surface opposed to the outlet to deflect a flow of fluid from the outlet of the sprinkler body, the deflector defining a first group of slots and a second group of slots disposed about the deflector axis, at least one of the first and second groups of slots having at least four pairs of opposed slots, each of the slots in each of the first and second groups of slots extending from the first surface through the deflector and from slot openings at an outer peripheral edge radially inward along a slot centerline to an innermost portion to define a slot length, each slot of the first group of slots having a slot length within a first range, each slot of the second group of slots having a slot length within a second range that is different than the first range, wherein at least two radially adjacent slots of the first group of slots define a tine therebetween, wherein the tine further includes one slot of the second group of slots disposed between the at least two radially adjacent slots of the first group, at least one pair of slots of one of the first and second group of slots having the innermost portion no further outward from the deflector axis than the peripheral surface of the apex, each slot of the other of the first and second group of slots having the innermost portion further outward from the deflector axis than the peripheral surface of the apex.

67. A pendent-type early suppression fast response (ESFR) fire protection sprinkler comprising:

a sprinkler body defining an orifice and an outlet for delivering a flow of fluid from a source to suppress a fire, the sprinkler body defining a K factor of about 17, the orifice defining an orifice axis, and the outlet being disposed generally coaxial with the orifice axis;

at least one arm extending from said sprinkler body;

an apex supported by said at least one arm, with an apex axis being generally coaxial with said orifice axis; and a deflector mounted to the apex, the deflector having a first, inside surface opposed to the flow of fluid and an opposite, second surface, and having a deflector axis generally coaxial with the orifice axis, the deflector defining at least one pair of generally opposing slots extending through the deflector, from the first, inside surface to the second, outside surface, the deflector having a thickness from the inside surface to the outside surface greater than about 0.06 inch, the deflector further having slot openings at an outer peripheral edge of the deflector, the slots extending inwardly from the peripheral edge generally toward the deflector axis along slot centerlines that extend radially outward the deflector axis, the slots having a first width transverse to the slot centerlines at a location spaced from the peripheral edge and a second width transverse to the slot centerlines at a location spaced inwardly, toward the deflector axis, relative to the peripheral edge, the second width being greater than the first width, the innermost portions of the slots extending inwardly toward the deflector axis to be no further outward from said deflector axis than an outermost surface of said apex so that said innermost portions of each of the slots extend inwardly toward the deflector axis to underlie the apex relative to the flow of fluid from the outlet of the body, the sprinkler providing in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the orifice axis.

68. The pendent-type fire protection sprinkler of claim 67, wherein the thickness of the deflector from the inside surface to the outside surface is equal to about 0.09 inch.

69. An early suppression fast response pendent-type fire protection sprinkler comprising:

a sprinkler body defining an orifice and an outlet that delivers a flow of fluid from a source, the sprinkler body having a K-factor of about 22 and a minimum design flowing pressure ranging from about 30 pounds per square inch to about 40 pounds per square inch at a most hydraulically remote sprinkler;

an apex having a first end and a second end, the second end of the apex being wider than the first end, the apex having an outer peripheral surface extending between the first and second end;

a thermally responsive assembly, the thermally responsive assembly being supported by the apex to maintain the outlet of the sprinkler body closed; and a deflector having a central deflector axis, being mounted adjacent the apex with a first surface opposed to the flow of fluid from the outlet to deflect the flow of fluid to suppress a fire in at least one of a single row rack storage, double row rack storage and multiple row rack storage in a storage area having a maximum ceiling height of 35 feet, the deflector defining a plurality of slots disposed about the deflector axis, at least one of the plurality of slots extending from the first surface through the deflector, and from a slot opening at an outer peripheral edge of the deflector inwardly along a slot centerline to an innermost portion to define a slot length, at least a portion of the at least one slot having a first width and a second width each width being generally transverse to the slot centerline of the at least one slot, the first width being different than the second width such a portion of that the at least one slot tapers in a direction along the slot centerline between the peripheral edge of the deflector and the peripheral surface of the apex, the sprinkler providing in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the axis.

70. The pendent-type fire protection sprinkler of claim 67, wherein the sprinkler has a hydraulic design with a hose stream allowance of about two hundred fifty gallons per minute (250 gpm) for a minimum water supply duration of one hour (1 hr.).

71. The pendent-type fire protection sprinkler of claim 67, wherein the test, the average water density is equal to or greater than about 1.15 gallons per minute per square foot is delivered for collection.

72. The pendent-type fire protection sprinkler of claim 71, wherein the average water density is equal to or greater than about 1.30 gallons per minute per square foot is delivered for collection.

73. The pendent-type fire protection sprinkler of claim 67, wherein the fire protection sprinkler adapted, upon impingement of a flow of fire-retardant fluid upon the deflector, to distribute the fire-retardant fluid over an area to be protected from fire, the area being generally confined within a spray pattern of the fire protection sprinkler, the spray pattern comprising at least three portions defined radially from a central axis of the fire protection sprinkler, a first portion being most radially central, a second portion being more radially distant, and a third portion being most radially remote, all with respect to the central axis, the fire retardant fluid being distributed by the fire protection sprinkler in a specific space quantity relationship in each of the portions such that the spray pattern is specifically adapted for fire suppression, wherein the first portion receives the relatively greatest quantity per unit area of fire retardant fluid within the spray pattern, the second portion receives a greater quantity per unit of fire retardant fluid within the spray pattern than the third portion, and the second portion is segregated into adjacent zones of different concentrations of fire retardant fluid.

74. The pendent-type fire protection sprinkler of claim 67, wherein the slots comprise re-entrant slots.

75. The pendent-type fire protection sprinkler of claim 74, wherein the re-entrant slots have one of an elongated shape and pear-shape.

76. The sprinkler of claim 58, wherein the at least two grouping of slots include a third group of slots.

77. The sprinkler of claim 76, wherein the third group of slots are non-radial slots.

78. The sprinkler of any one of claims 50, 51, 52, 53, 54, 55, 57, 58-65, and 66, wherein the test, the average water density provided by the sprinkler is greater than or equal to about 1.15 gallons per minute per square foot into the one foot long by one foot wide pan.

79. The sprinkler of claim 78, wherein the test, the average water density provided by the sprinkler is greater than or equal to about 1.3 gallons per minute per square foot into the one foot long by one foot wide pan.

80. An early suppression fast response pendent-type fire protection sprinkler comprising:

a sprinkler body defining an orifice and an outlet for delivering a flow of fluid from a source, the sprinkler body defining a K factor of about 17, the orifice defining an orifice axis, and the outlet being disposed generally coaxial with the orifice axis;

a pair of frame arms disposed in a plane, the frame arms having a first end extending from the body and a second end distal of the body;

an apex supported by the frame arms, the apex having a peripheral surface and defining an apex axis generally coaxial with said orifice axis; and a deflector mounted to the apex having a first inside surface opposed to the outlet to deflect a flow of fluid from the outlet to suppress a fire, and a second outside surface opposite the first surface facing away from the outlet to define a thickness of the deflector being greater than about 0.06 inch, the deflector defining a deflector axis generally coaxial with the orifice axis, the deflector defining a plurality of slots extending through the deflector, from the first, inside surface to the second, outside surface, each of the plurality of slots having a slot opening at an outer peripheral edge of the deflector and extending inwardly from the peripheral edge generally toward the deflector axis along slot centerlines that extend radially toward the deflector axis to an innermost portion, the plurality of slots having:

a first group of slots including at least four pairs of generally opposing slots symmetrically located around the deflector axis, each of the slots of the first group having a first width transverse to the slot centerlines in a first region of the peripheral edge and a second width transverse to the slot centerlines at a second region spaced inwardly from the peripheral edge, the second width being greater than the first width to define reentrant slots, the first width being about 0.10 inch, at least one pair of opposing slots of the first group having their innermost portions extending inwardly toward the deflector axis to underlie the apex relative to the outlet; and a second group of slots including at least two pairs symmetrically positioned between adjacent reentrant slots, each of the first and second groups of slots having four slots disposed to one side of the plane, each of the slots of the second group having their innermost portion extend inwardly toward the deflector axis to between the peripheral surface of the apex and the peripheral edge of the deflector, each of the second group of slots having a slot width transverse to the slot centerline being different than at least one of the first and second widths of the first group of slots.

81. The sprinkler of claim 80, wherein the deflector has a thickness from the inside surface to the outside surface of about 0.09 inch.

82. The sprinkler of claim 80, wherein radially adjacent slots of the first group are angularly spaced from each other by about 40°.

83. The sprinkler of any one of claims 59-63, 66, 80, the sprinkler providing in a test performed in accordance with the "Ten Pan Distribution Test" described in the Apr. 8, 1997, edition of UL 199, Standard for Automatic Sprinklers for Fire Protection Service at a flowing water rate of 100 gallons per minute, an average water density of equal to or greater than about 1.00 gallons per minute per square foot into a one foot long by one foot wide pan centered at a three foot radius from the deflector axis.

* * * * *